US007191719B2

(12) United States Patent
Hayashi et al.

(10) Patent No.: US 7,191,719 B2
(45) Date of Patent: Mar. 20, 2007

(54) THREADER FOR SEWING MACHINE

(75) Inventors: Kazutoshi Hayashi, Nagoya (JP); Noboru Mizuno, Nagoya (JP); Masayuki Hori, Gifu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/178,484

(22) Filed: Jul. 12, 2005

(65) Prior Publication Data

US 2006/0011118 A1 Jan. 19, 2006

(30) Foreign Application Priority Data

Jul. 15, 2004 (JP) ..... 2004-208376

(51) Int. Cl.
*D05B 87/00* (2006.01)

(52) U.S. Cl. ..... 112/225

(58) Field of Classification Search ..... None
See application file for complete search history.

(56) References Cited

U.S. PATENT DOCUMENTS 4,651,660 A 3/1987 Oshima et al.
5,003,899 A 4/1991 Ogawa
5,092,257 A * 3/1992 Ogawa ..... 112/225
5,143,005 A 9/1992 Jimenez et al.
6,655,306 B2 * 12/2003 Kotaki ..... 112/225
6,701,858 B2 * 3/2004 Wacker ..... 112/225
6,761,121 B2 * 7/2004 Kotaki ..... 112/225
6,779,470 B2 8/2004 Sakakibara et al.
6,814,016 B2 * 11/2004 Hori ..... 112/225
6,959,656 B2 * 11/2005 Fukao ..... 112/225
2002/0195037 A1 12/2002 Kotaki

FOREIGN PATENT DOCUMENTS

GB 1184085 3/1970
JP A-02-220690 9/1990

* cited by examiner

*Primary Examiner*—Danny Worrell
(74) *Attorney, Agent, or Firm*—Oliff & Berridge, PLC

(57) ABSTRACT

A threader for a sewing machine includes a thread tension regulator, a thread take-up spring, a thread take-up lever, a thread transferer setting a needle thread drawn from a thread supply onto the thread tension regulator, the thread take-up spring and the thread take-up lever so that the thread tension regulator, the thread take-up spring and the thread take-up lever are threaded, a path forming member forming a guide path guiding the thread transferee so that the thread transferer is moved, a driving unit driving the thread transferer, and a drive transmitting member transmitting drive of the driving unit to the thread transferer.

6 Claims, 28 Drawing Sheets

CONTROL FOR TRANSFER OF
FRIST TRANSFERRING MEMBER

THREADER FOR SEWING MACHINE

BACKGROUND OF THE INVENTION

1. Field of the Invention

This invention relates to a threader for a sewing machine drawing a needle thread from a thread supply to thread guards such as a thread tension regulator, a thread take-up spring, a thread take-up lever and the like, and more particularly to such a threader in which a thread transferer is transferred via a transmitting member from an upper standby position to a lower thread passing position such that the thread tension regulator, the thread take-up spring and the thread take-up lever are automatically threaded.

2. Description of the Related Art

In conventional sewing machines, a needle thread is drawn from a thread spool so that a plurality of threaded portions are threaded in a predetermined sequence through a predetermined passage. The threaded portions include a thread tension regulator, a thread take-up spring, a thread take-up lever and the like. Subsequently, when the sewing machine is provided with a needle threading mechanism, the needle thread is finally passed through a thread eye of a sewing needle by the needle threading mechanism, whereupon the sewing machine is in a sewable condition.

Various types of sewing machines have been practiced in which a plurality of threaded portions are manually threaded by an operator. Recently, however, various types of sewing machines have been proposed in which a needle thread drawn from the thread spool is caught on a transferring member, which is transferred so that a plurality of threaded portions are automatically threaded.

For example, JP-A-H02-220690 discloses a simplified thread-setting sewing machine comprising a needle thread guide device provided between needle thread guide and a thread take-up spring, an upper rotating member secured to a rotating member shaft connected to a needle thread supplying stepping motor, a lower driven member pivotally mounted on a driven member shaft and a looped toothed belt extending between the upper rotating member and the lower driven member. The toothed belt has inwardly directed teeth and a protrusion-like thread guide formed on an outer periphery thereof. In threading the sewing machine, when the toothed belt is driven in a predetermined rotational direction, a previously set needle thread is caught by the thread guide which has been moved upward. The needle thread is transferred downward by the thread guide so that the lower thread take-up spring is threaded.

In the aforementioned thread-setting sewing machine, the employed toothed belt is a special toothed belt with the protrusion-like thread guide but not a general toothed belt. As a result, the toothed belt increases the production cost.

Furthermore, a thread transfer path in sewing machines is generally formed into a curved shape conforming to a curvilinearly designed appearance of the sewing machine. On the other hand, when constructed so as to transfer the needle thread by a toothed belt, the thread transfer path is constructed by substantially the same plane as a linear installation path of the toothed belt since the toothed belt is installed linearly between a plurality of driven members. As a result, a freedom is limited in the design of sewing machine appearance.

Conversely, the installation path of the toothed belt is rendered complicated in order that the toothed belt is installed curvilinearly along the curvilinearly designed appearance of the sewing machine. When the installation path becomes complicated, a large number of driven members need to be disposed and it is difficult to apply a proper tension to the toothed belt. As a result, the driving force of the rotating member cannot accurately be transmitted to the toothed belt.

Still furthermore, the toothed belt is controlled by the needle thread supplying stepping motor. Accordingly, the sewing machine needs to be assembled so that the thread guide is accurately located at an initial position thereof at a start time of control. This complicates the assembling work and requires a lot of assembling time.

SUMMARY OF THE INVENTION

Therefore, an object of the present invention is to provide a threader for a sewing machine which can improve the freedom of a guide path guiding a drive transmitting member and which can reduce the production cost.

It is an object of the present invention to provide a threader for a sewing machine comprising a thread tension regulator, a thread take-up spring, a thread take-up lever, a thread transferer setting a needle thread drawn from a thread supply onto the thread tension regulator, the thread take-up spring and the thread take-up lever so that the thread tension regulator, the thread take-up spring and the thread take-up lever, a path forming member forming a guide path guiding the thread transferer so that the thread transferer is moved, a driving unit driving the thread transferer, and a drive transmitting member transmitting drive of the driving unit to the thread transferer.

In an embodiment, the thread transferer, path forming member, driving unit and drive transmitting member are provided in the aforementioned threader. Accordingly, when the drive transmitting member is driven by the driving unit, drive of the driving unit is transmitted via the drive transmitting member to the thread transferer, so that the thread transferer is guided by the path forming member while carrying the needle thread drawn from the thread spool. Thus, since the thread transferer is moved along the predetermined thread transferring path, the needle thread can be set on the thread tension regulator, thread take-up spring, thread take-up lever so that the thread tension regulator, thread take-up spring, thread take-up lever are threaded, sequentially.

In another embodiment, the drive transmitting member comprises an endless looped toothed belt including a number of teeth directed outward relative to the loop. As a result, when an inside flat portion of the toothed belt loop is slid on the continuous guide wall, the thread transferer can be guided smoothly without use of a pulley with gear teeth. Consequently, the guide path of the toothed belt can easily be formed. Moreover, since various configurations of guide paths such as a curved path can be constituted by the guide wall, the degree of freedom of the guide path can be improved as well as the guide path can be formed easily and economically. Additionally, since a general toothed belt is used, the cost of the drive transmitting member can be reduced.

BRIEF DESCRIPTION OF THE DRAWINGS

Other objects, features and advantages of the present invention will become clear upon reviewing the following description of the embodiment with reference to the accompanying drawings, in which.

DETAILED DESCRIPTION OF THE INVENTION

Figure 1:
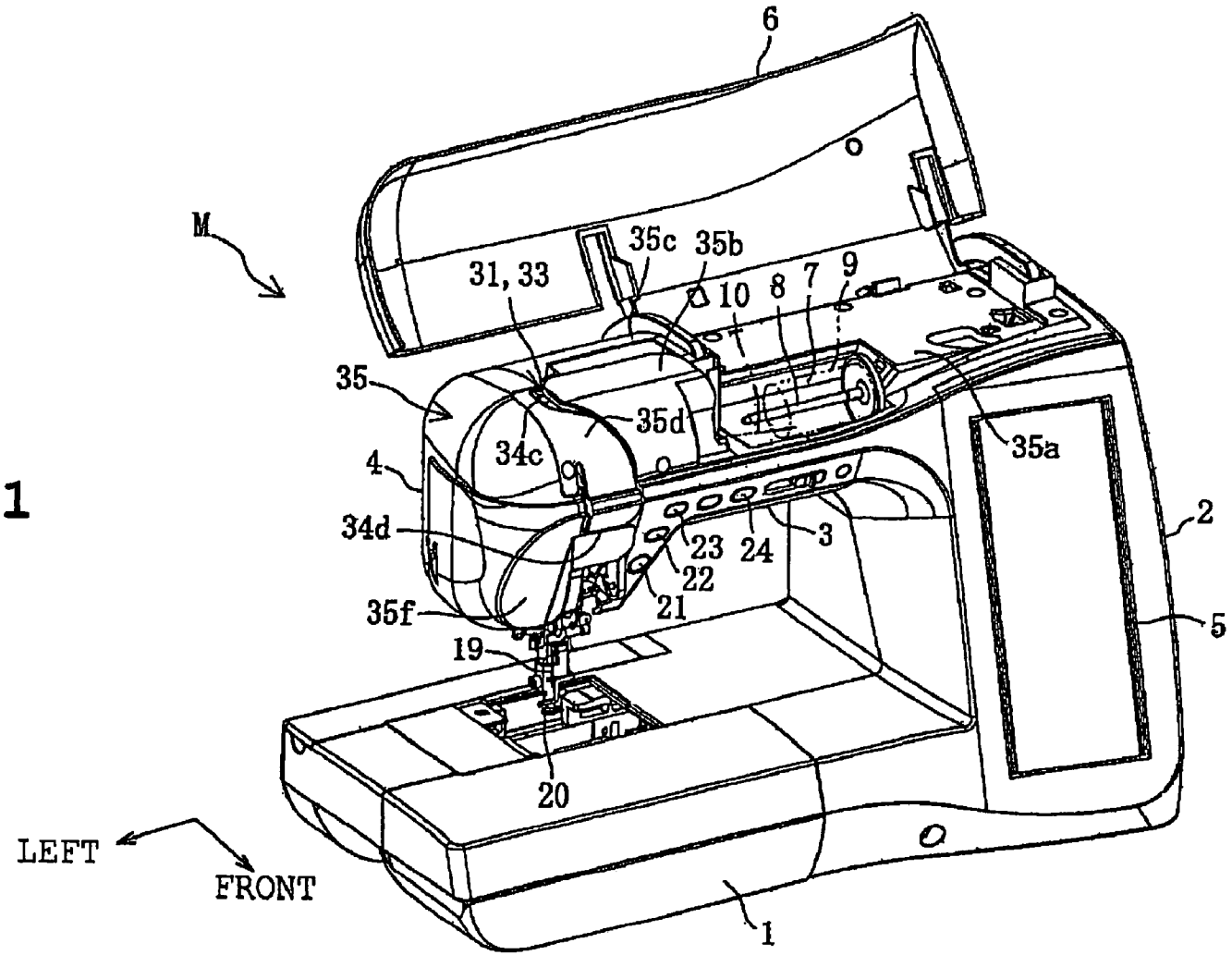
FIG. 1 is a perspective view of a sewing machine provided with a threader of one embodiment of the present invention.
Figure 2:
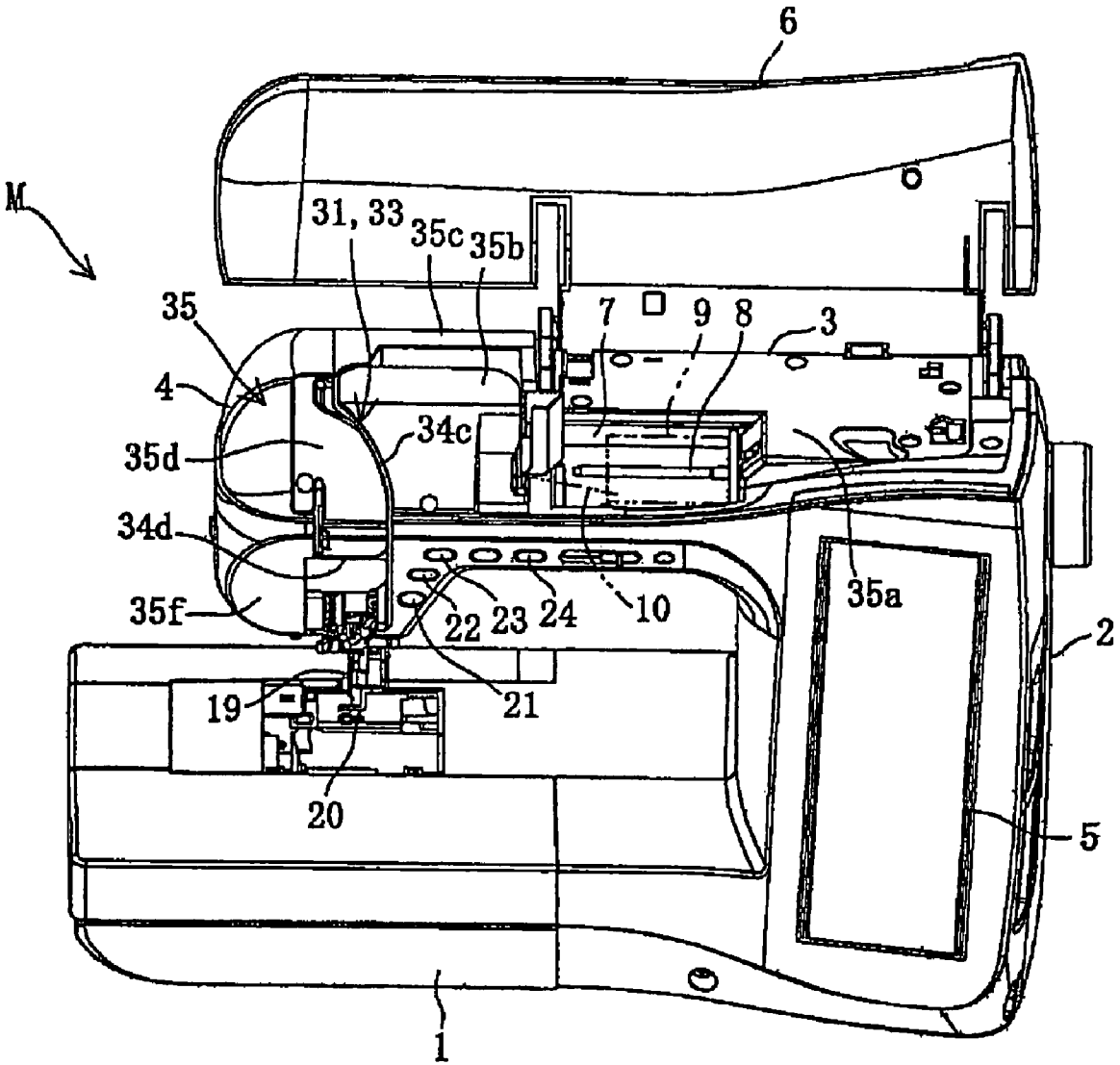
FIG. 2 is also a perspective view of the sewing machine.
Figure 3:
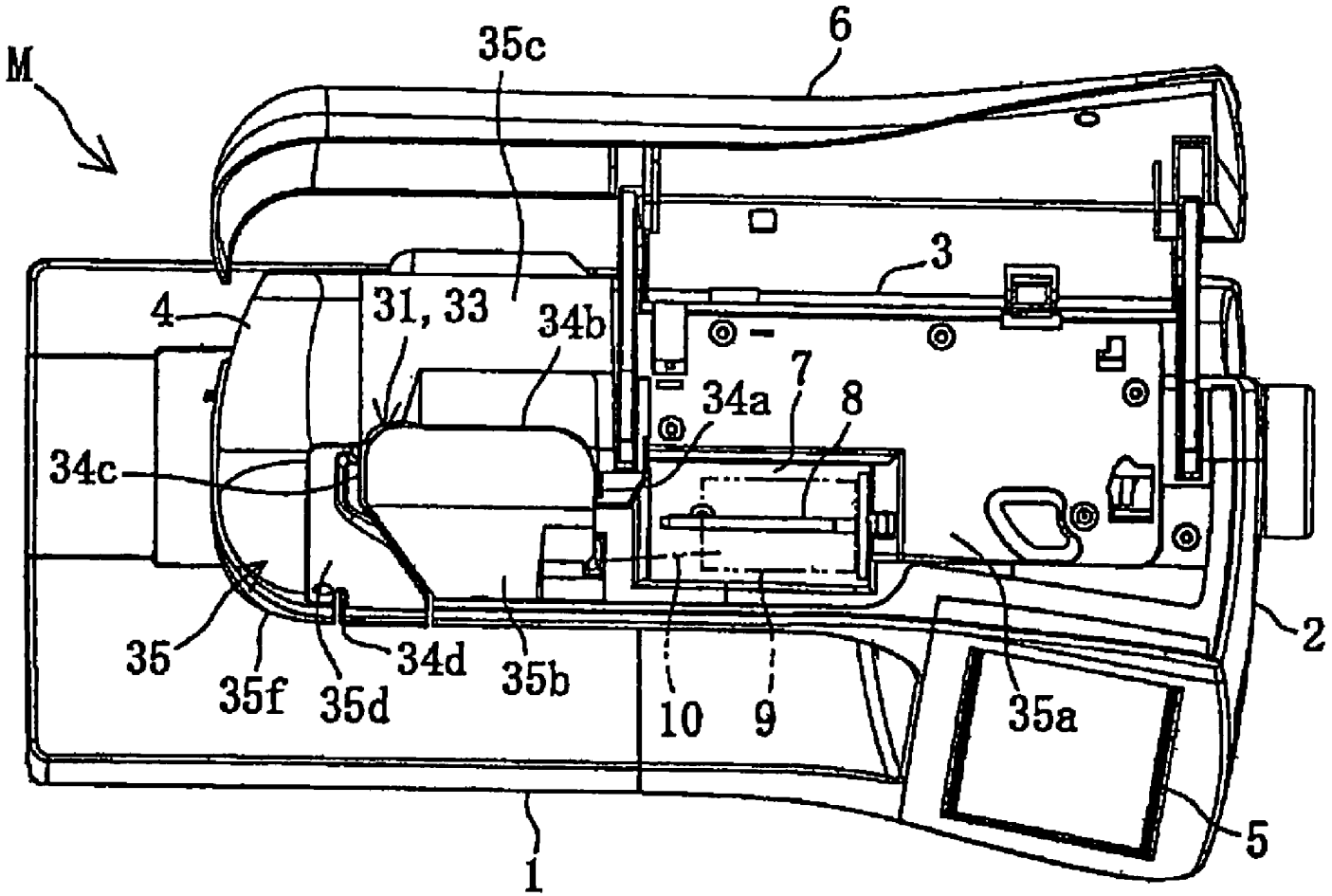
FIG. 3 is a plan view of the sewing machine.
Figure 4:
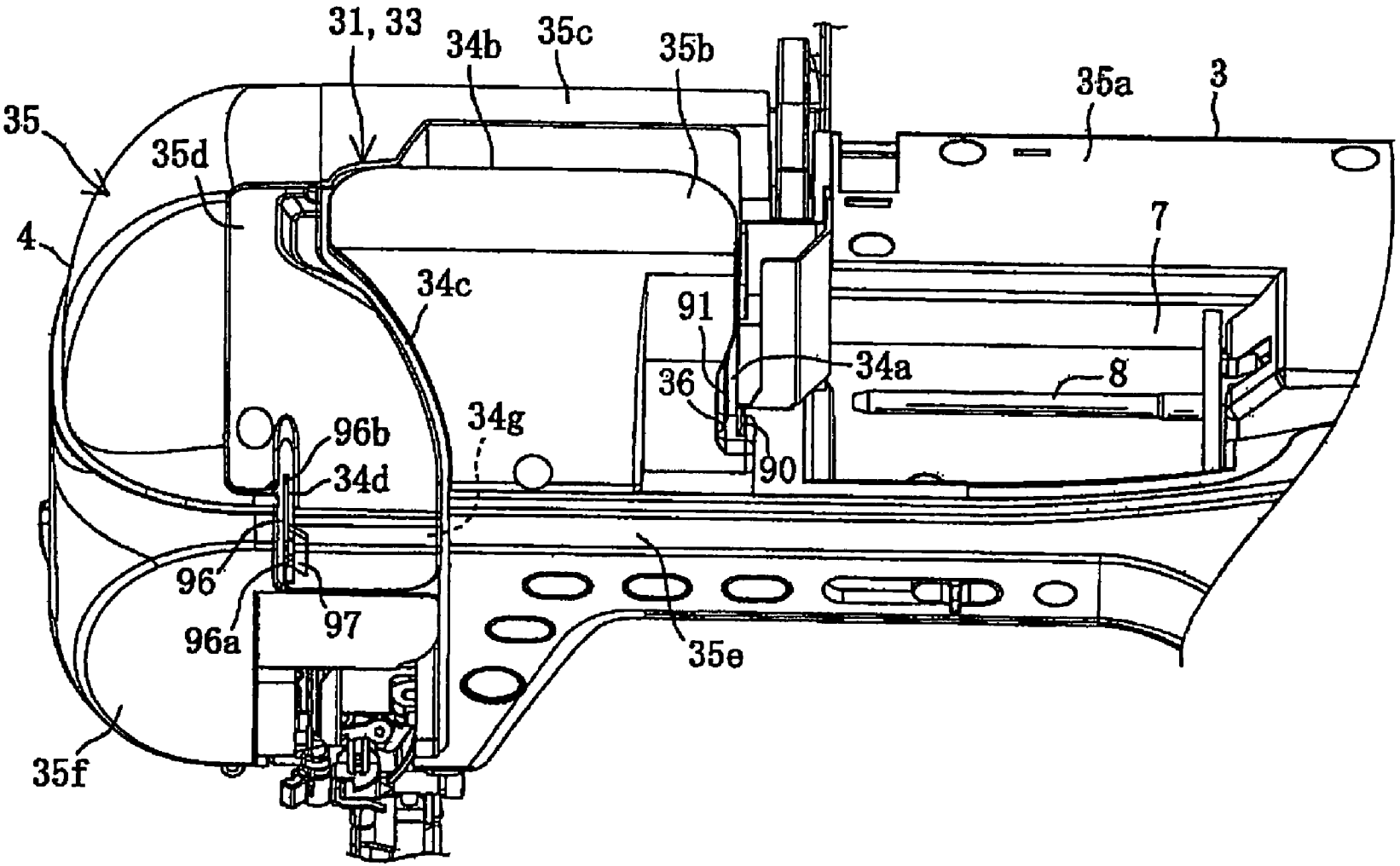
FIG. 4 is a partially enlarged view of the sewing machine in FIG. 2.

One embodiment of the present invention will be described with reference to the accompanying drawings. Referring to FIGS. 1 to 3, a sewing machine M includes a sewing bed 1, a pillar 2 standing from a right end of the bed 1, a sewing arm 3 extending leftward from an upper end of the pillar 2 so as to be opposed along the bed 1 and a machine head 4 located at a left end of the arm 3. A needle plate (not shown) is mounted on the bed 1, and a shuttle (not shown) is provided under the needle plate. A bobbin on which a needle thread is wound is detachably attached to the shuttle. A large vertically elongated liquid crystal display 5 is mounted on a front of the pillar 2.

A cover 6 is mounted on the arm 3 so as to cover an upper part of the arm 3. The cover 6 extends over an entire length of the arm 3 and is pivotally mounted on an upper rear of the arm 3 so as to be opened and closed about a horizontal axis. A thread accommodating recess 7 is formed in an upper part of the arm 3 on the right of the sewing head 4. A spool pin 8 is provided in the recess 7. A thread spool 9 serving as a thread supply is attached to the spool pin 8 thereby to be accommodated sideways in the recess 7. A needle thread 10 is drawn from the thread spool 9 through a plurality of threaded portions such as a thread tension regulator 14, a thread take-up spring 15 and a thread take-up lever 13 sequentially to be finally passed through a thread eye 19*a* of a sewing needle 19 attached to a lower end of a needle bar 11 (see FIGS. 16A and 17A).

Referring to FIGS. 3 to 5 and 8, in the head 4 are provided the needle bar 11, a presser bar 12, the thread take-up lever 13, the thread tension regulator 14, a thread take-up spring 15, an automatic threading device 16, an automatic needle threading mechanism 17 and the like. The needle bar 11 is mounted on a sewing machine frame so as to be vertically reciprocated. The needle bar 11 has a lower end on which a needle bar thread guide 18 and the sewing needle 19 are mounted. The needle bar 11 is vertically driven by a sewing machine driving mechanism (not shown) including a sewing machine motor 28 (see FIG. 18).

The presser bar 12 is disposed in the rear of the needle bar 11 and mounted on the sewing machine frame so as to be vertically movable. A presser foot 20 is attached to the presser bar 12. On the front of the arm 3 are provided a sewing start switch 21, a sewing finish switch 22, an automatic threading preparation switch 23, an automatic threading start switch 24 and the like in a row.

Figure 5:
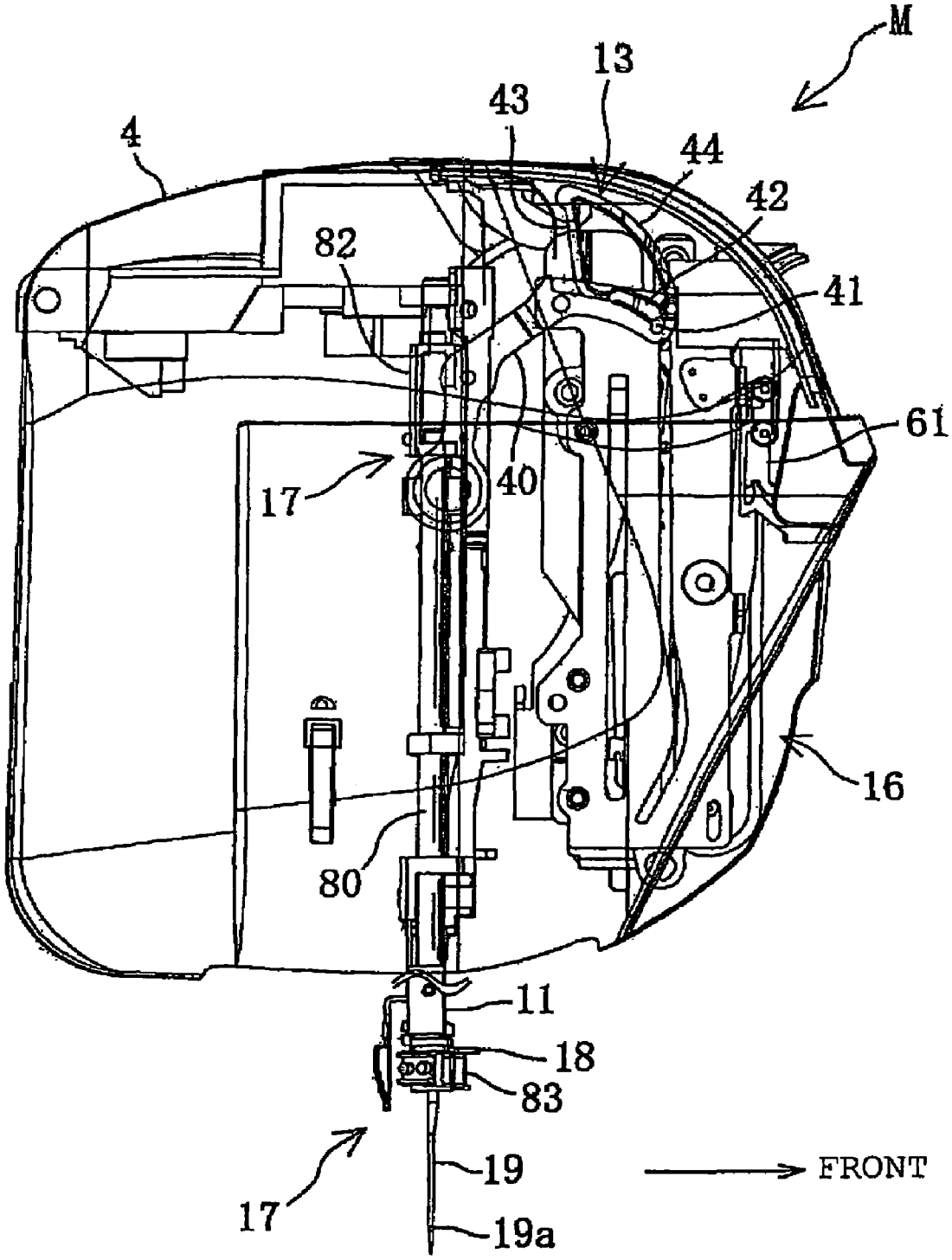
FIG. 5 is a perspective left side view of the sewing machine in an automatic threadable state.
Figure 6:
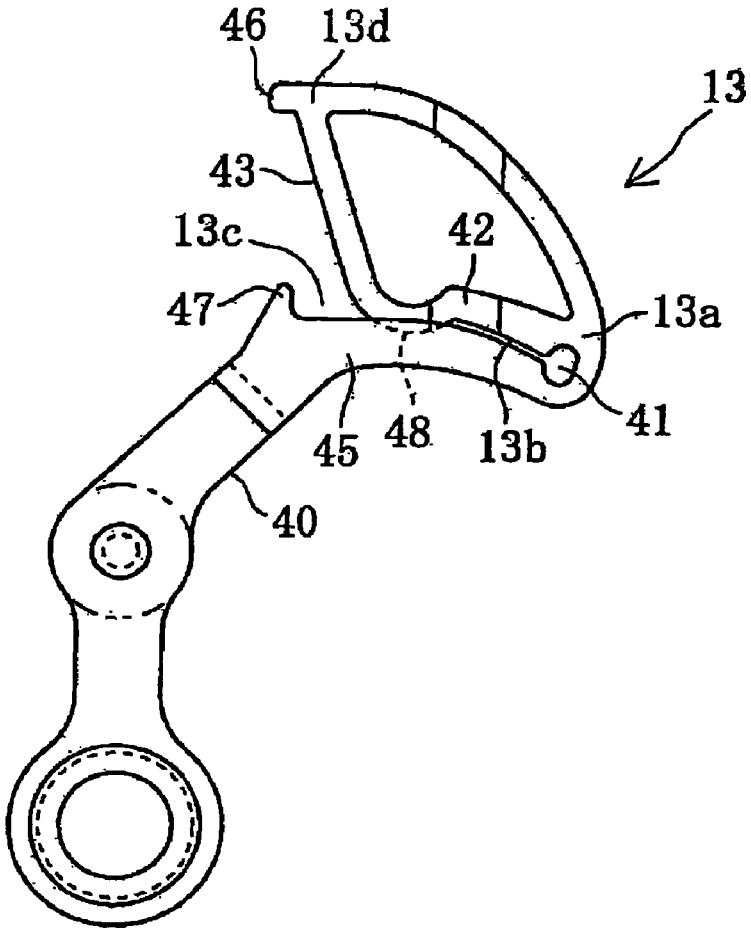
FIG. 6 is a left side view of a thread take-up lever.
Figure 7:
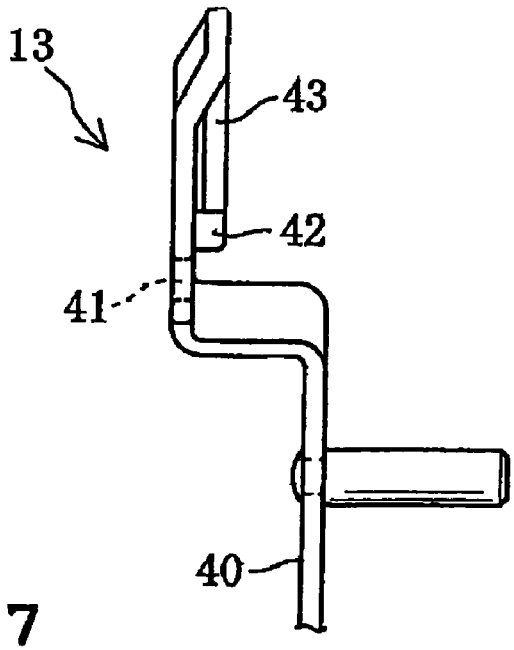
FIG. 7 is a front view of the thread take-up lever.
Figure 8:
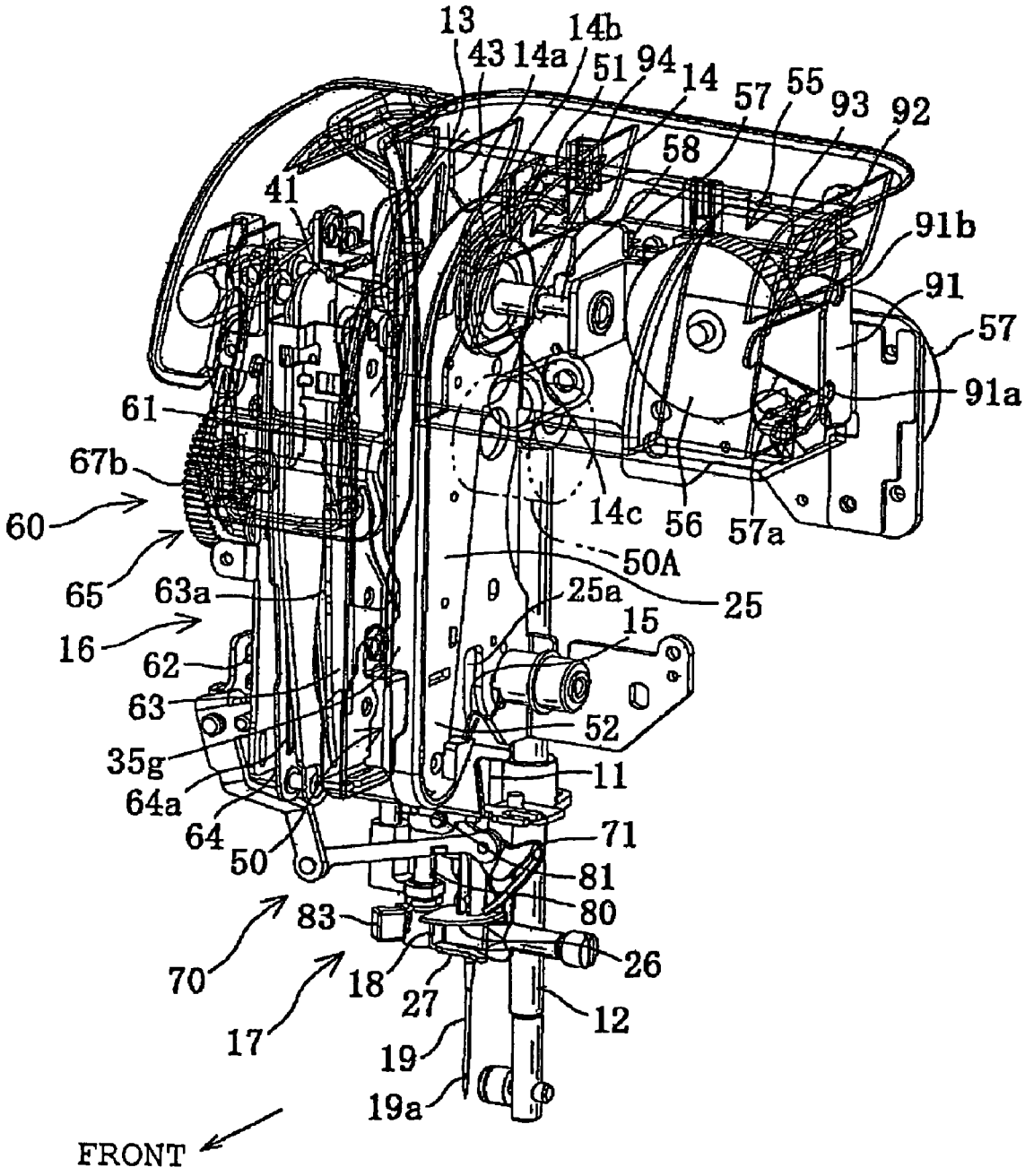
FIG. 8 is a perspective view of an automatic threader and an automatic needle threading mechanism as viewed over the upper right of the sewing machine.
Figure 9:
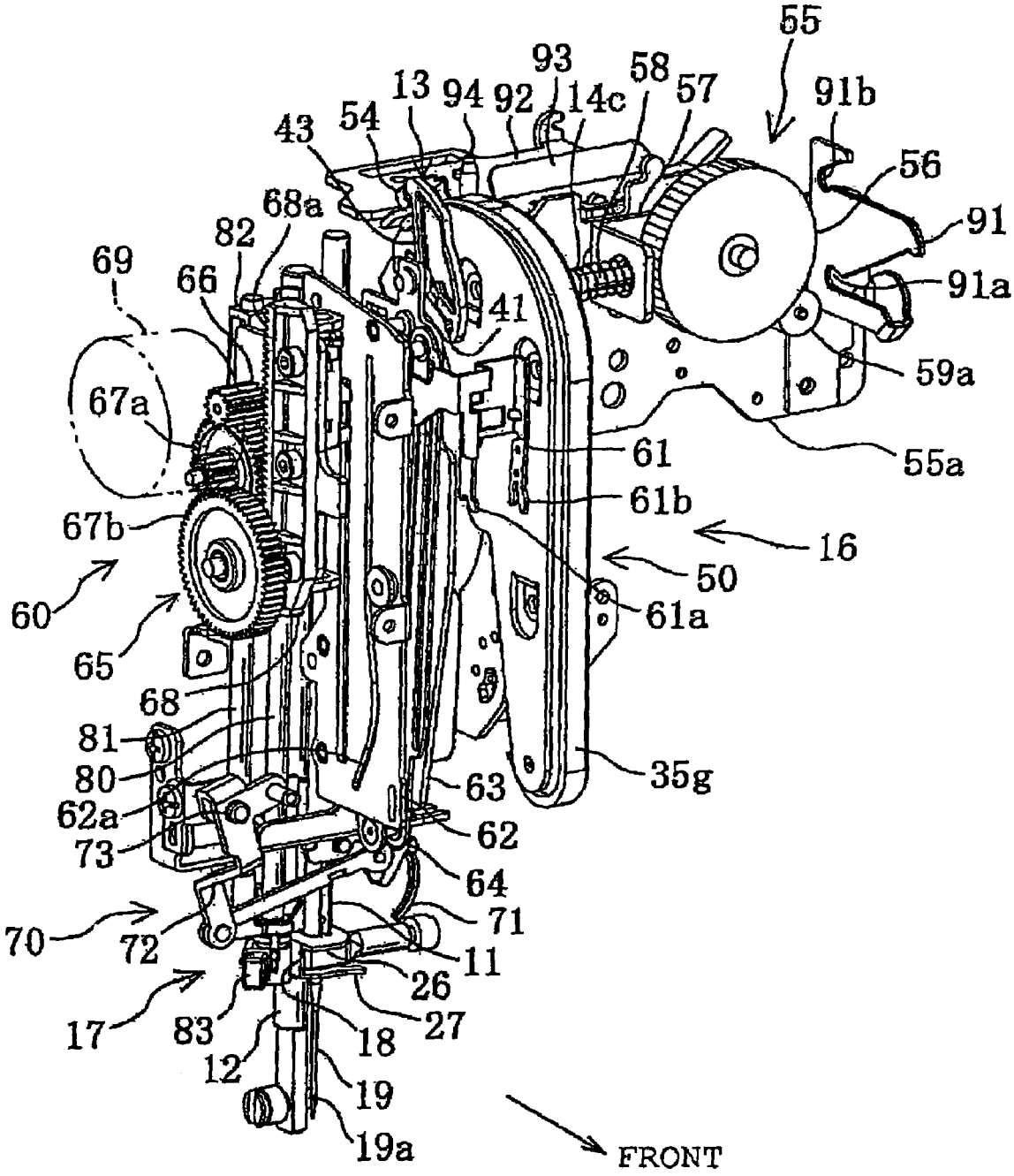
FIG. 9 is a perspective view of the automatic threader and the automatic needle threading mechanism as viewed over the upper left of the sewing machine.

Referring now to FIGS. 5 to 7, the thread take-up lever 13 is located in front of and over the needle bar 11. The thread take-up lever 13 has a proximal end serving as a lever body 40 as will be described later. The lever body 40 has a lower end mounted on the sewing machine frame so as to pivot about a horizontal axis. The thread take-up lever 13 is vertically swung in synchronization with the needle bar 11 by the sewing machine driving mechanism.

The thread tension regulator 14 has a pair of thread tension discs 14*a* and 14*b* and is disposed on the right of the thread take-up lever 13 or at the thread spool 9 side (upstream with respect to the thread take-up lever 13) so as to be directed right and left. The paired thread tension discs 14*a* and 14*b* are mounted via a horizontal thread tension shaft 14*c* to an upper end of a first guide frame 25 of the automatic threading device 16. The thread take-up spring 15 is mounted on a lower end of the first guide frame 25 located below the thread tension regulator 14 (upstream with respect to the thread take-up lever 13 and downstream with respect to the thread tension regulator 14). The thread take-up spring 15 is capable of elastically biasing the needle thread 10.

Referring to FIGS. 1 to 4, 8, 16A and 17B, the sewing machine M is provided with a thread preparation path 30 which automatically prepares the needle thread 10 drawn from the thread spool 9 to be set on a plurality of threaded portions (the thread tension regulator 14, the thread take-up spring 15, the thread take-up lever 13, the needle bar thread guide 18 and the like) by the automatic threading device 16 and further to be automatically passed through the thread eye 19*a* of the sewing needle 19 by the automatic needle threading mechanism 17. A thread introducing groove 31 is formed in a sewing machine cover 35 so as to be able to introduce the needle thread 10 into the thread preparation path 30.

The thread introducing groove 31 will now be described. Referring to FIGS. 1 to 4, the sewing machine cover 35 covering the upper portion of the arm 3 has a plurality of divided covers including an upper cover 35*a*, a thread introducing groove cover 35*b*, a rear cover 35*c*, a thread guide cover 35*d*, a front cover 35*e* covering a large part of a lower front of the arm 3, a large face plate 35*f* covering a large part of the head 4 and the like. The thread accommodating recess 7 is formed in the upper cover 35*a*. The upper cover 35*a* has a left end located in the center of the arm 3. An introducing groove 34*a* is formed between the upper cover 35*a* and the thread introducing groove cover 35*b* located on the left hand of the upper cover 35*a*. An introducing groove 34*b* is formed between the thread introducing groove cover 35*b* and the rear cover 35*c* located in the rear of the thread introducing groove cover 35*b*. A curved introducing groove 34*c* is formed between the thread guide cover 35*d*, and the thread introducing groove cover 35*b* and front cover 35*e*. A generally L-shaped introducing groove 34*d* is formed between the thread guide cover 35*d* and the face plate 35*f*. The introducing grooves 34*a*, 34*b* and 34*c* are serially connected to one another, and the introducing groove 34*d* extends from a lower end of the introducing groove 34*c*. The introducing grooves 34*a* to 34*d* constitute a thread introducing groove 31.

The thread take-up lever 13 will now be described in brief. The thread take-up lever 13 is formed into a generally gently angled shape in a side view and into the shape of a crank in a front view, as shown in FIGS. 5 to 7. The thread take-up lever 13 is vertically swung by the sewing machine driving mechanism (not shown). The thread take-up lever 13 includes a lever threaded portion 41 which is formed integrally with the lever body 40 and on which the needle thread 10 is set so that sewing is executable. The thread take-up lever 13 further includes a lever thread introducing portion 42 introducing the needle thread 10 to the lever threaded portion 41 and an introduction guide portion 43 guiding the needle thread 10 to the lever thread introducing portion 42.

The lever threaded portion 41 is a small elliptic thread hole formed in the lever distal end 13*a* and communicates with an introduction guide portion 43 comprising a space defined between a thread receiving portion 45 extending from the lever body 40 to the lever distal end 13*a* and the lever thread introducing portion 42. The needle thread 10 is introduced through the thread introducing groove 13*b* to the lever threaded portion 41. The introduction guide portion 43 is comprised of a linear section which has substantially the same length as a distance from a thread introducing opening 13*c* which is an opening end of the thread introducing groove 13*b* to the lever thread introducing portion 42 and which makes an angle of about 120° with the thread receiving portion 45.

The introduction guide portion 43 has an end 13*d* formed with a first thread locking portion 46 which locks the needle thread 10 set on the introduction guide portion 43 so that the needle thread 10 can be prevented from being disengaged to the side opposed to the thread receiving portion 45. Furthermore, the thread receiving portion 45 has a proximal end formed with a second thread locking portion 47 which locks the needle thread 10 received by the thread receiving portion 45 so that the needle thread 10 can be prevented from being disengaged to the side opposed to the lever thread introducing portion 42.

A junction of the lever thread introducing portion 42 and the introduction guide portion 43 is formed with a protrusion 48 protruding toward the thread receiving portion 45. The protrusion 48 is formed so as to overlap the thread receiving portion 45. When the needle thread 10 has been introduced to the lever threaded portion 41, the protrusion 48 prevents the needle thread 10 from falling off through a gap between the thread receiving portion 45 and the lever thread introducing portion 42.

The sewing machine M is mechanically constructed and electrically arranged so that the needle thread 10 can be set on the thread preparation path 30 when the thread take-up lever 13 has been changed to a thread catch position in the vicinity of an upper limit position, as shown in FIG. 5. When the thread take-up lever 13 has not been located at the thread catch position, the automatic threading preparation switch 23 is operated so that the sewing machine motor 28 is driven to move the thread take-up lever 13 automatically to the thread catch position.

As shown in FIG. 5, when the thread take-up lever 13 has been changed to the thread catch position, the introduction guide portion 43 is inclined so as to make an angle of about 80° with a horizontal plane, whereby the introduction guide portion 43 is moved forward as the same goes downward. Furthermore, the lever thread introducing portion 42 is inclined so as to make an angle of about 20° with a horizontal plane, whereby the lever thread introducing portion 42 is moved forward as the same goes downward. The needle thread 10 located in the thread preparation path 30 is to be set on the introduction guide portion 43 from a rear thereof.

The automatic threading device 16 will now be described. Referring to FIGS. 8 to 10, 16A to 16F and 17A to 17F, the automatic threading device 16 includes a first thread transferring mechanism 50 serving as a threader, a first stepping motor 50A for driving the first thread transferring mechanism 50, a second thread transferring mechanism 60 and a second stepping motor 69 for driving the second thread transferring mechanism 60. The first thread transferring mechanism 50 includes a first thread transferring member 54 (serving as a thread transferer) transferring the needle thread 10 previously set in the thread preparation path 30 to set the needle thread 10 on a plurality of the threaded portions (the thread tension regulator 14, the thread take-up spring 15, the thread take-up lever 13 and the like). The second thread transferring mechanism 60 includes a second thread transferring member 61 transferring to the sewing needle 19 the needle thread 10 located downstream with respect to the thread take-up lever 13.

When transferred by the first thread transferring mechanism 50, the first thread transferring member 54 catches the needle thread 10 located upstream with respect to the introduction guide portion 43 of the thread take-up lever 13, transferring the needle thread 10 toward the thread take-up spring 15. During the thread transfer, the needle thread 10 is set on the thread tension regulator 14 so that the thread tension regulator 14 is threaded. At a final stage of the thread transfer, the needle thread 10 is set on the thread take-up spring 15 so that the thread take-up spring 15 is threaded. In cooperation of the first and second thread transferring members 54 and 61, the needle thread 10 is set on the lever threaded portion 41 during the thread transfer so that the lever threaded portion 41 is threaded.

The first thread transferring mechanism 50 includes a groove forming member 51 fixed to a first guide frame 25, a toothed belt 52 accommodated in the groove forming member 51, a guide portion forming member 53 fixed to the groove forming member 51, a first thread transferring member 54 driven by the toothed belt 52, a first stepping motor 50A transferred by the toothed belt 52 and a first stepping motor 50A transferring the first thread transferring member 54.

Figure 11:
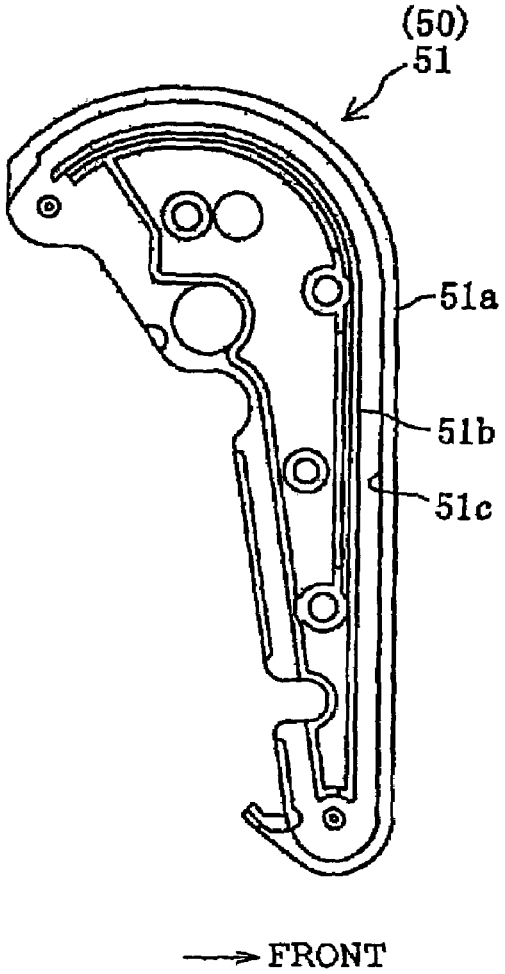
FIG. 11 is a left side view of a groove forming member.
Figure 12:
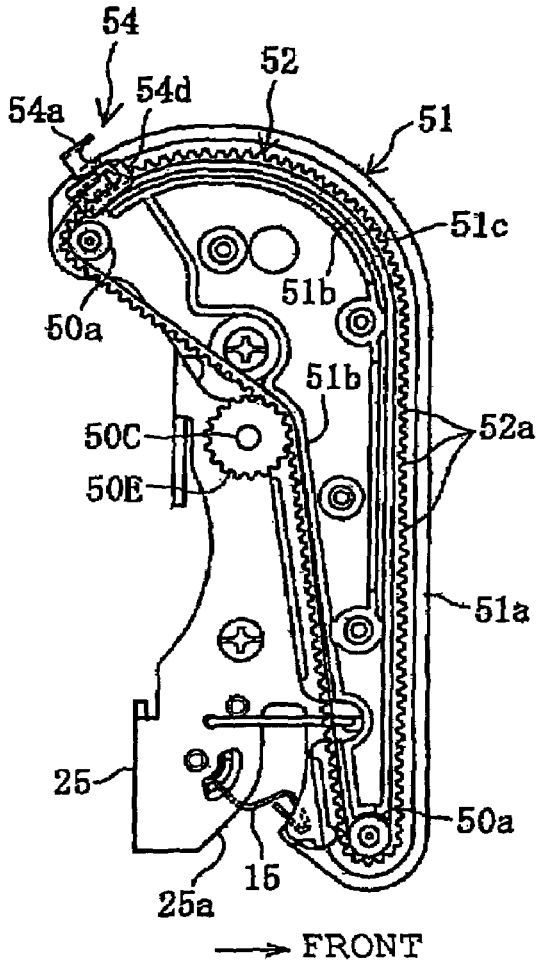
FIG. 12 is also a left side view of the groove forming member with a toothed belt being assembled into the groove forming member.

The groove forming member 51 is a plate-shaped member made from a synthetic resin and disposed in parallel to a plane on which the thread take-up lever 13 is vertically swung, as shown in FIG. 11. The groove forming member 51 is formed into a generally inverted J-shape and is fixed to a left side face of the first guide frame 25 by a plurality of small screws. A generally inverted J-shaped guide groove 51*c* is defined by an outer peripheral side wall 51*a* and an inner peripheral side wall 51*b* near an outer edge of the left side face of the groove forming member 51. The guide groove 51*c* guides the toothed belt 52, thereby serving at least as a part of a guide path guiding the first thread transferring member 54.

Two small rollers 50*a* are rotatably mounted on the groove forming member 51 and are disposed at an upper rear end and a lower portion of the guide groove 51*c* so as to face the guide groove 51*c* respectively. The toothed belt 52 is made of a rubber into an endless loop and inserted in the guide groove 51*c* with teeth 52*a* thereof being directed outward with respect to the loop. As a result, the toothed belt 52 is guided along the guide groove 51*c* while an inside flat portion of the toothed belt 52 is being slid on an inner peripheral side wall 51*b*, whereupon the toothed belt 52 is reciprocally movable clockwise and counterclockwise.

Figure 10:
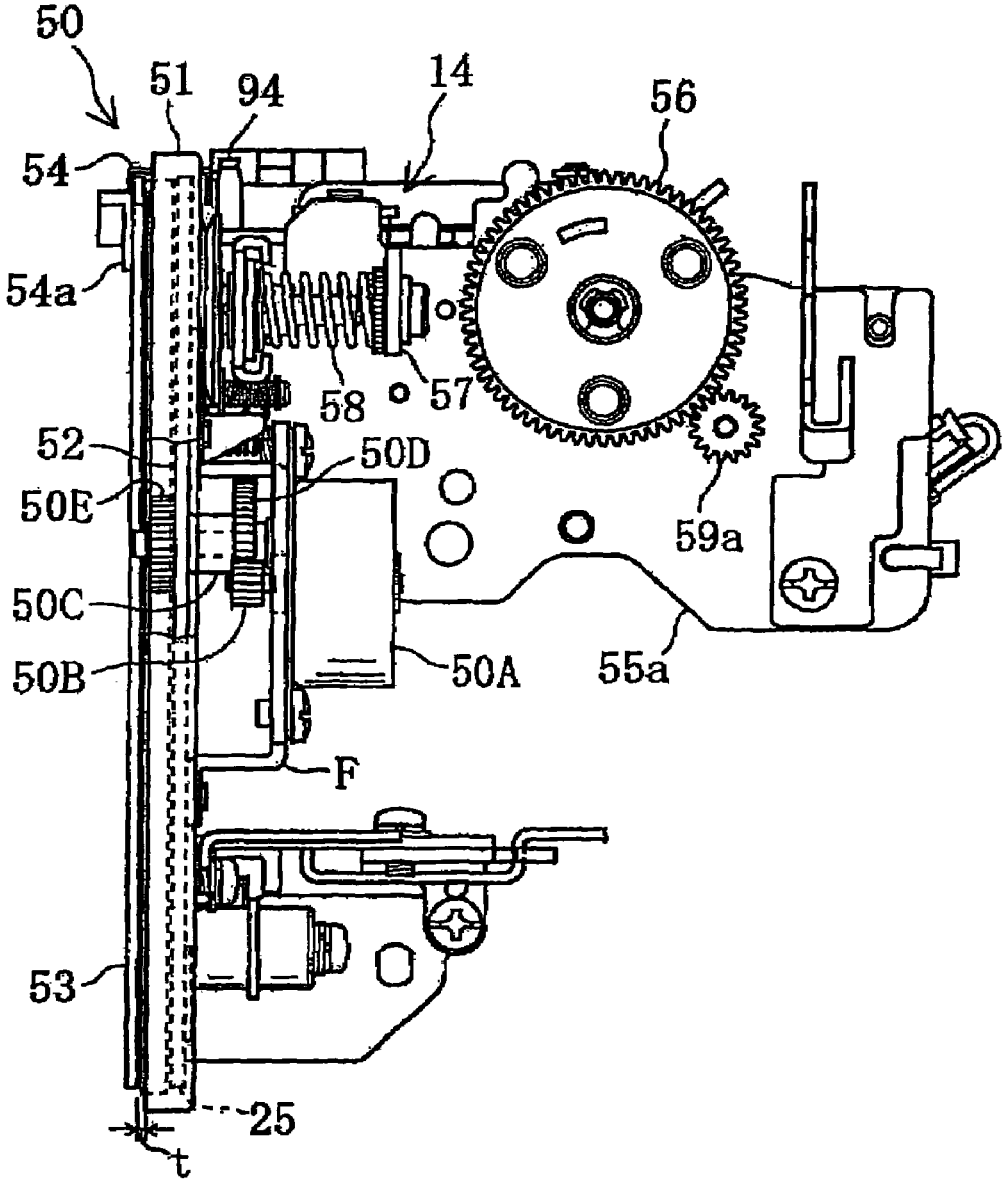
FIG. 10 is a front view of a first thread transferring mechanism.
Figure 13:
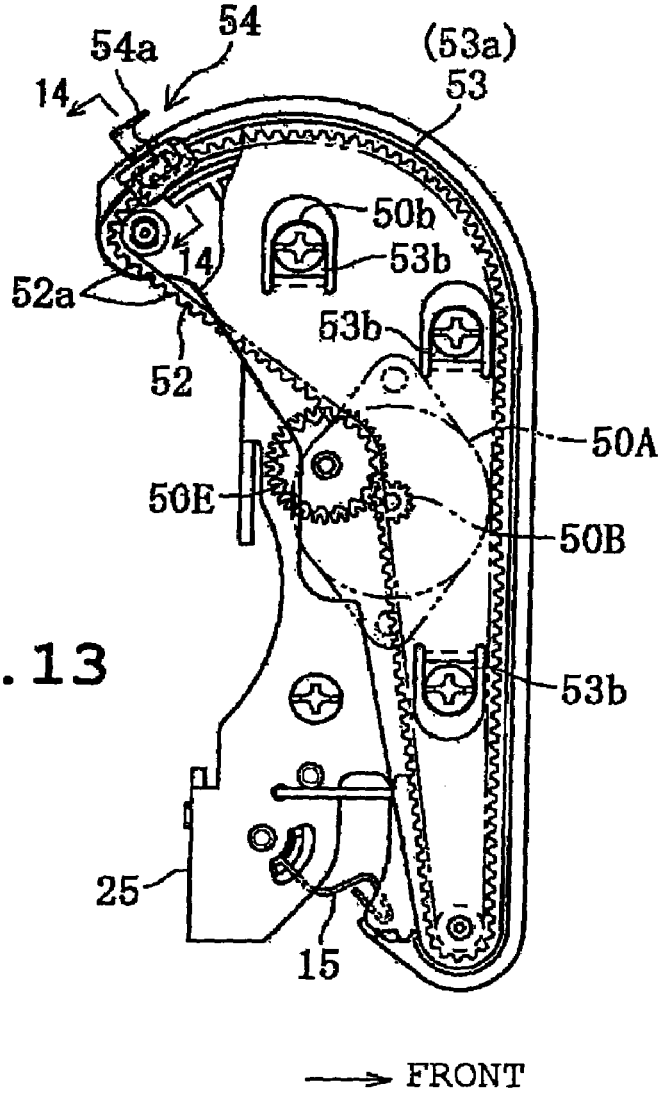
FIG. 13 is a view similar to FIG. 12, showing the groove forming member with the toothed belt and a guide portion forming member being assembled into the groove forming member.
Figure 14:
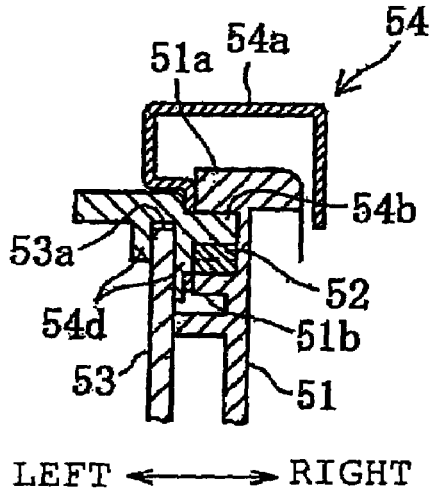
FIG. 14 is a longitudinal section taken along line 14—14 in FIG. 13.
Figure 15A:
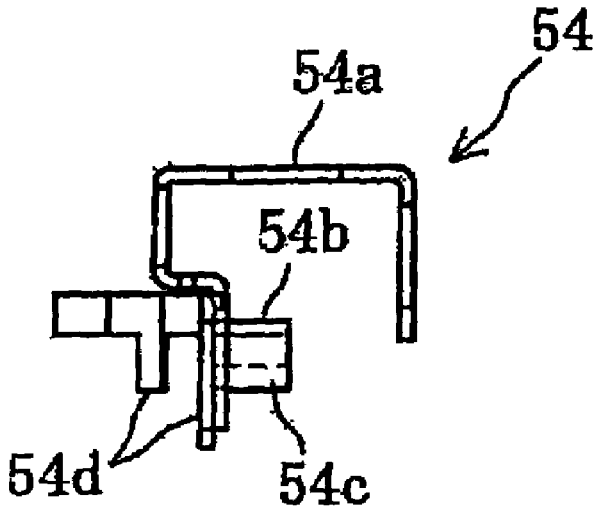
FIGS. 15A and 15B are front and right side views of a first thread transferring member respectively.
Figure 15B:
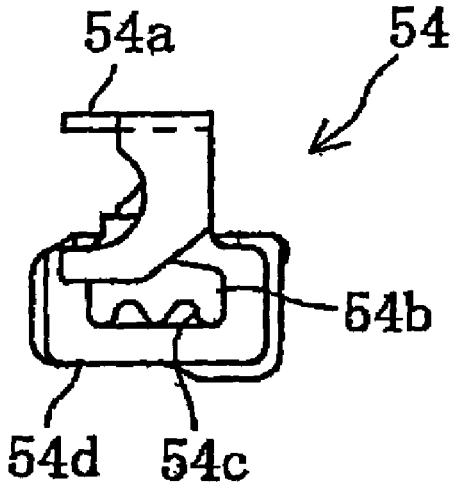

The guide portion forming member 53 comprises a metal plate having a generally inverted J-shaped outer edge extending along the guide groove 51*c* as shown in FIG. 13. The outer edge of the plate is formed with a guide portion 53*a* guiding the first thread transferring member 54. The guide portion forming member 53 has three screwed portions 53*b* protruding at the groove forming member 51 side so as to be in parallel to the groove forming member 51. Accordingly, as shown in FIG. 10, when fixed to the groove forming member 51 with the screws 50*b* being inserted through the screwed portions 53*b* respectively, the guide portion forming member 53 is disposed at a position spaced away from the guide groove 51*c* side by a predetermined distance t so as to be in parallel to the groove forming member 51.

The first thread transferring member 54 has a generally arch-shaped thread hook 54*a* exposed outward through a passing gap resulting from the spacing between the guide portion forming member 53 and the groove forming member 51 by the predetermined distance t as shown in FIGS. 12 to 14, 15A and 16B. The first thread transferring member 54 further has a support portion 54*b* secured integrally to one of legs of the thread hook 54*a* and a bifurcated guided portion 54*d*. The support portion 54*b* is in engagement with the teeth 52*a* of the toothed belt 52 in the guide groove 51*c* with engagement teeth 54*c* being interposed therebetween. When slid along the guide portion 53*a* of the guide portion forming member 53, the guided portions 54*d* are guided along the inverted J-shaped guide path of the outer edge of the guide portion forming member 53 from the upper standby position to the lower thread pass position.

The first stepping motor 50A is secured to the support frame F and has a drive shaft to which is secured a driving gear 50B in mesh engagement with a driven gear 50D of a pivot shaft 50C pivotally mounted on the support frame F. The pivot shaft 50C has a front end to which is secured a sprocket 50E which is in engagement with a part of the toothed belt 52. Accordingly, when the first stepping motor 50A is driven for normal rotation, the first thread transferring member 54 is continuously moved downward from the standby position to the thread pass position by the movement of the sprocket 50E and the toothed belt 52. Furthermore, when the first stepping motor 54 is driven for reverse rotation, the first thread transferring member 54 is continuously moved upward from thread pass position to the standby position by the movement of the sprocket 50E and the toothed belt 52.

The thread tension discs 14*a* and 14*b* of the thread tension regulator 14 are mounted via a thread tension shaft 14*c* to an upper end of a right side of the first guide frame 25. The thread take-up spring 15 biased by a spring (not shown) is mounted to a lower end of the first guide frame 25. A notch 25*a* is formed in a lower part of the first guide frame 25 so as to be depressed upward from the lower end of the frame. The thread take-up spring 15 faces the notch 25*a*, whereupon the thread take-up spring 15 sufficiently exhibits a thread catching function for the needle thread 10 the thread take-up spring 15 engages through the notch 25*a* from below.

Figure 16A:
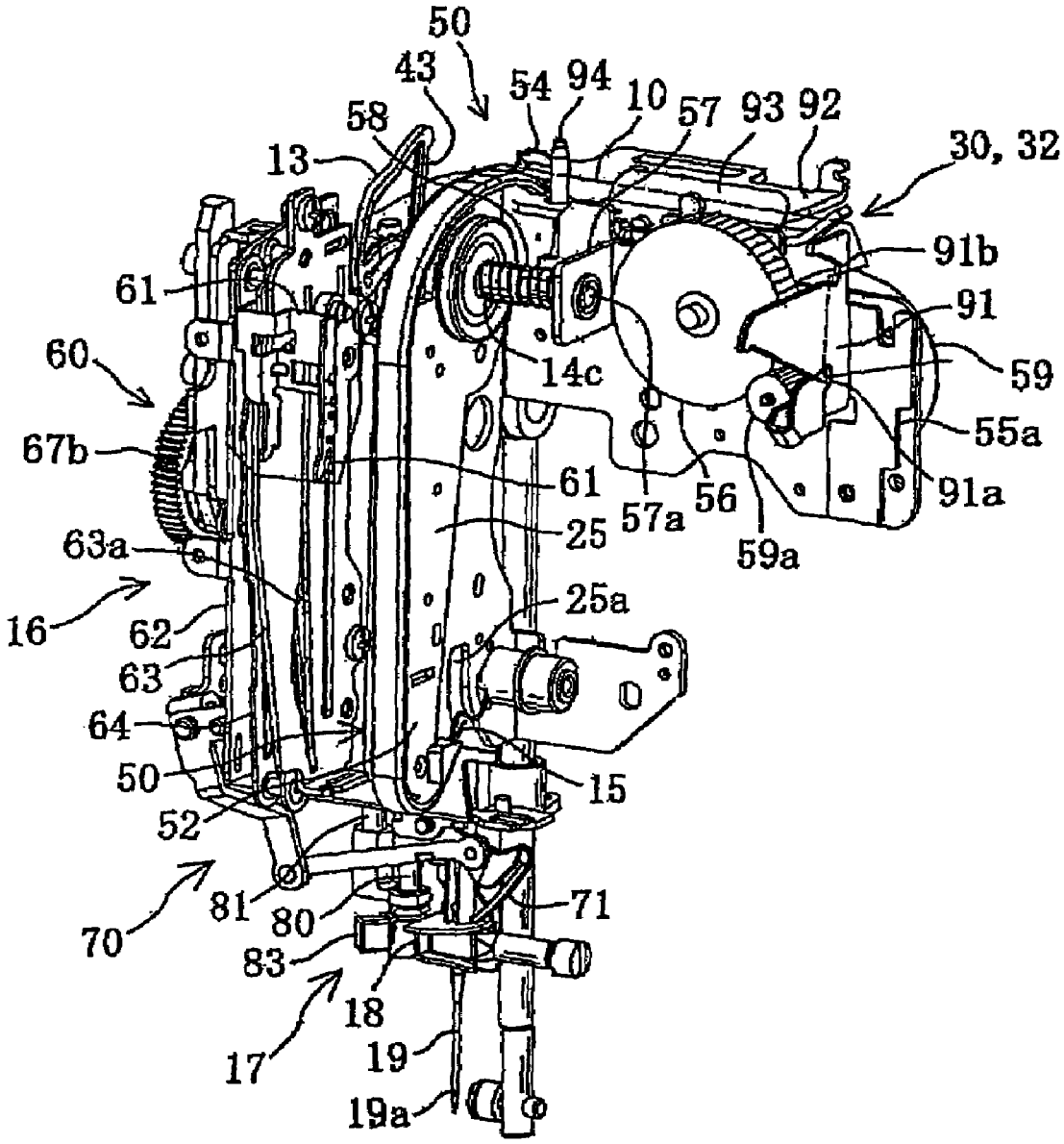
FIG. 16A is a perspective view of the automatic threader and the automatic needle threading mechanism in a standby state.
Figure 16B:
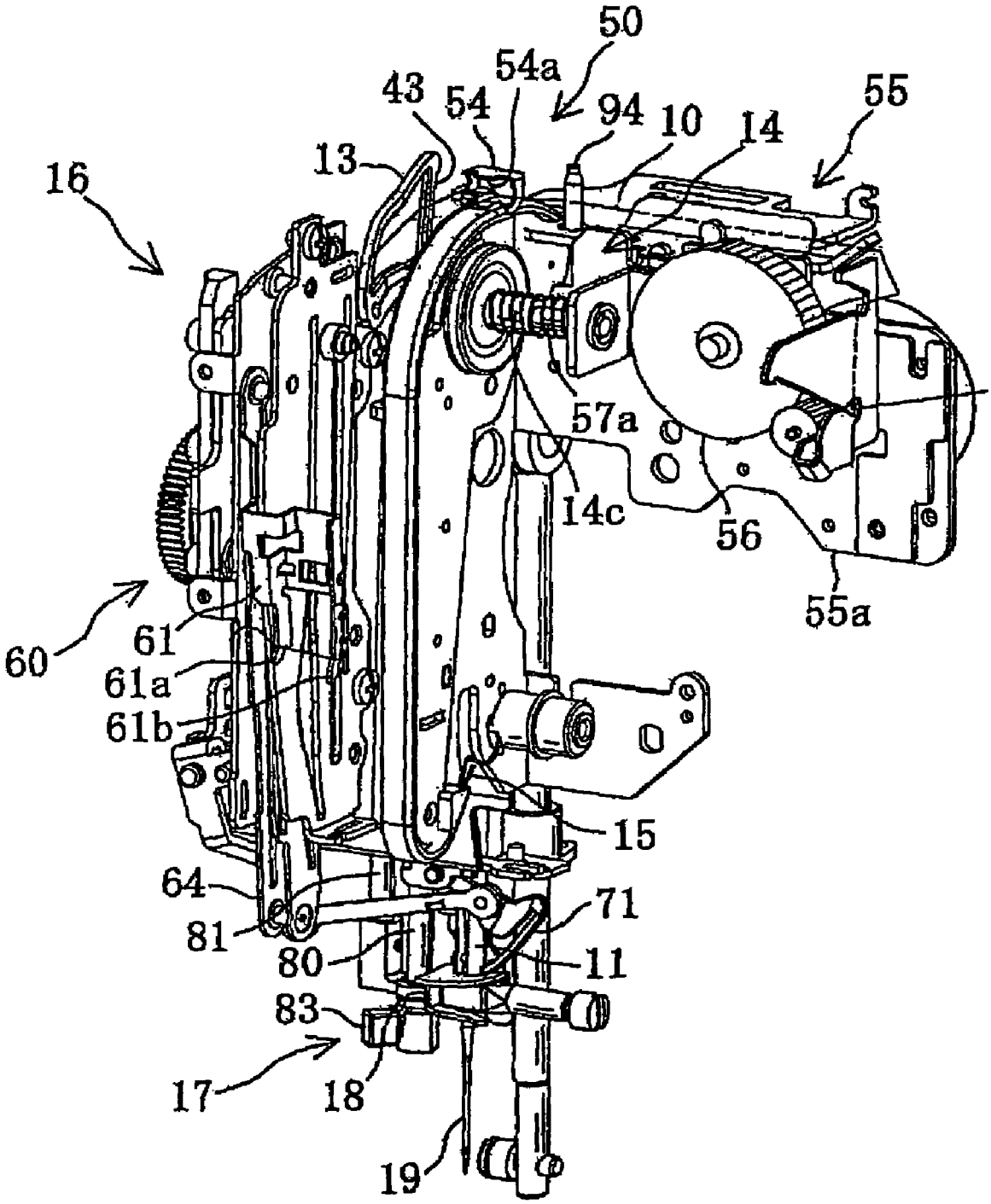
FIG. 16B is a perspective view of the automatic threader and the automatic needle threading mechanism in a condition where the sewing machine has been threaded.
Figure 17A:
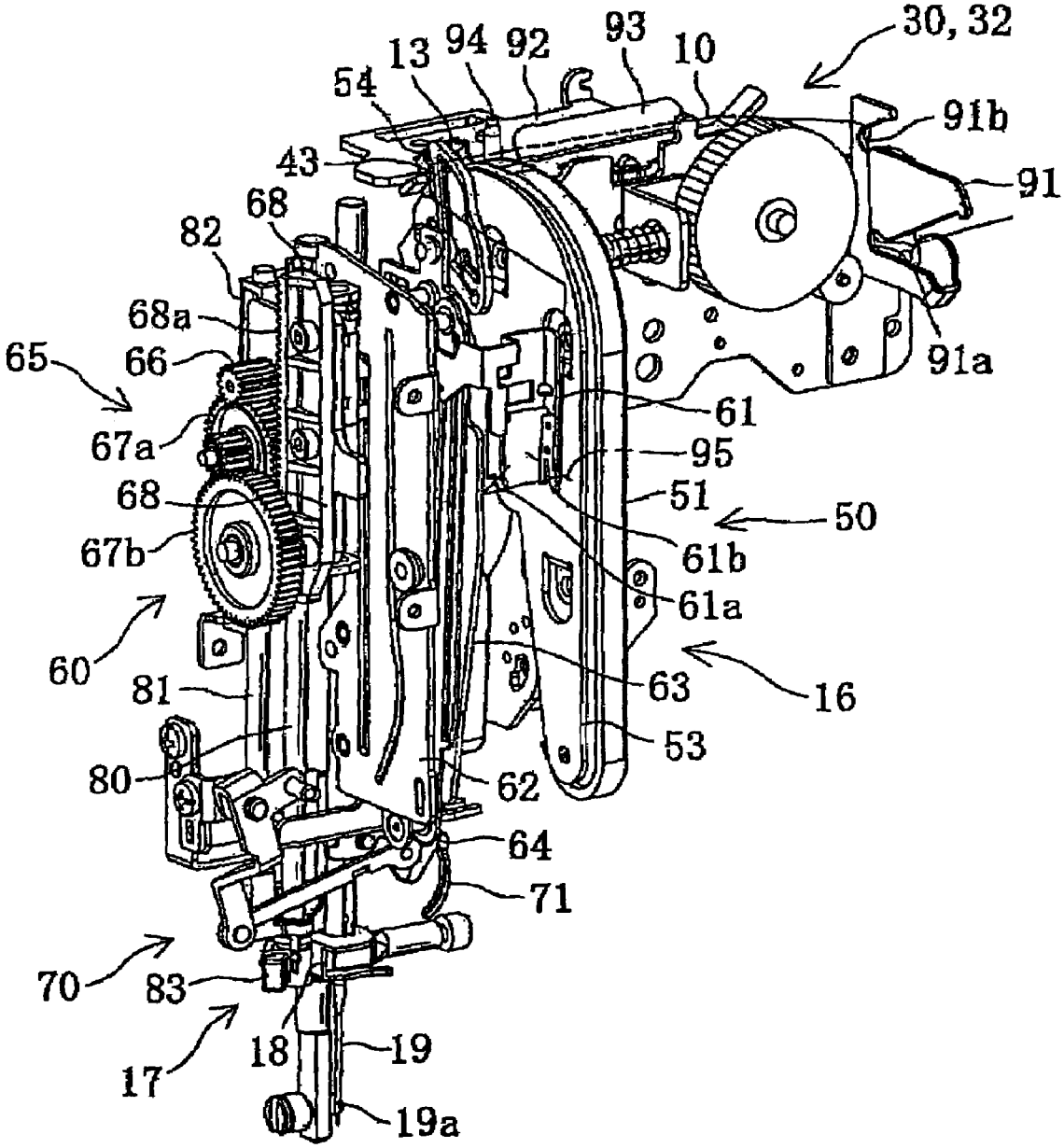
FIG. 17A is a perspective view of the automatic threader and the automatic needle threading mechanism in a standby state.
Figure 17B:
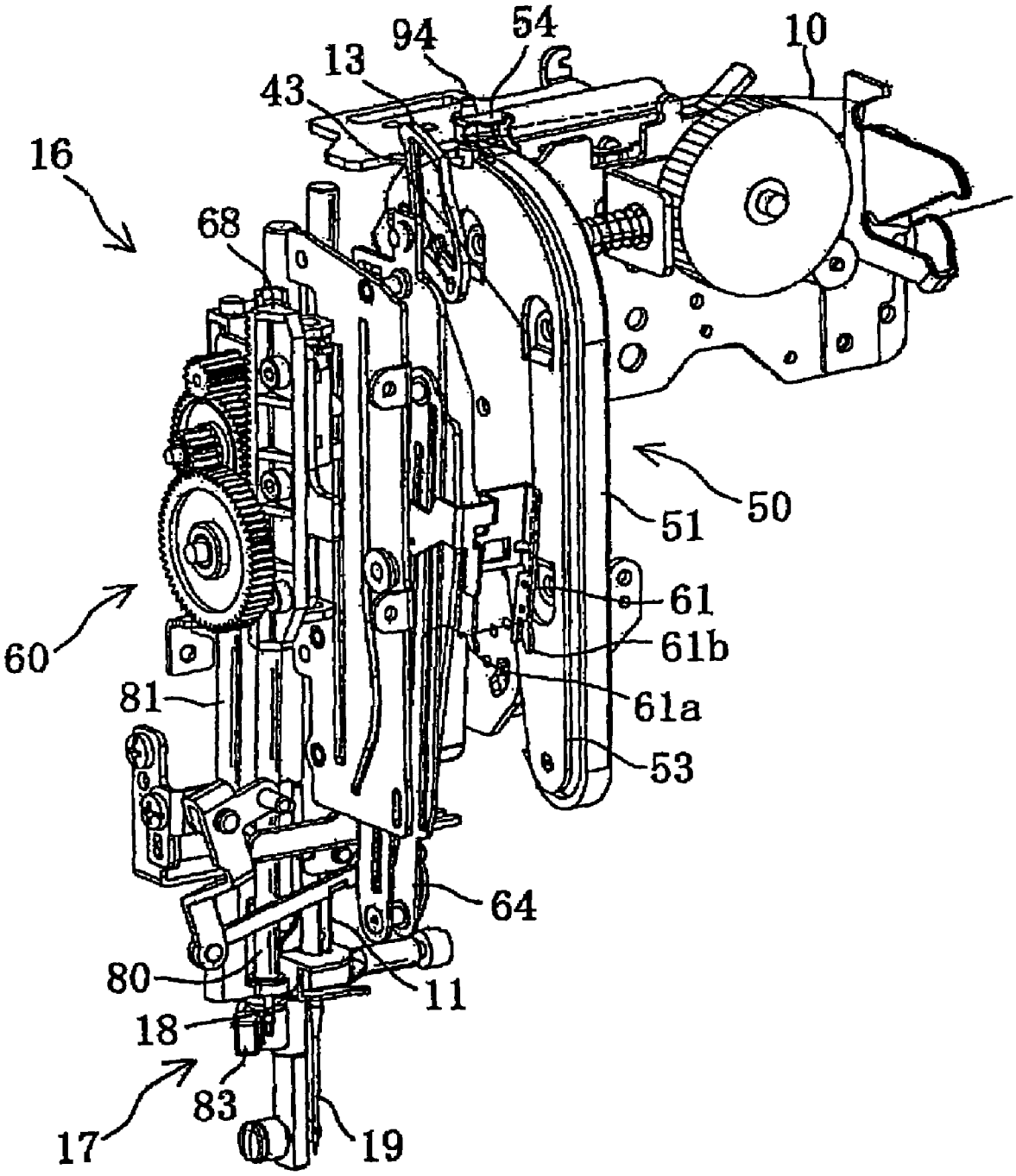
FIG. 17B is a perspective view of the automatic threader and the automatic needle threading mechanism in a condition where the sewing machine has been threaded.
Figure 20A:
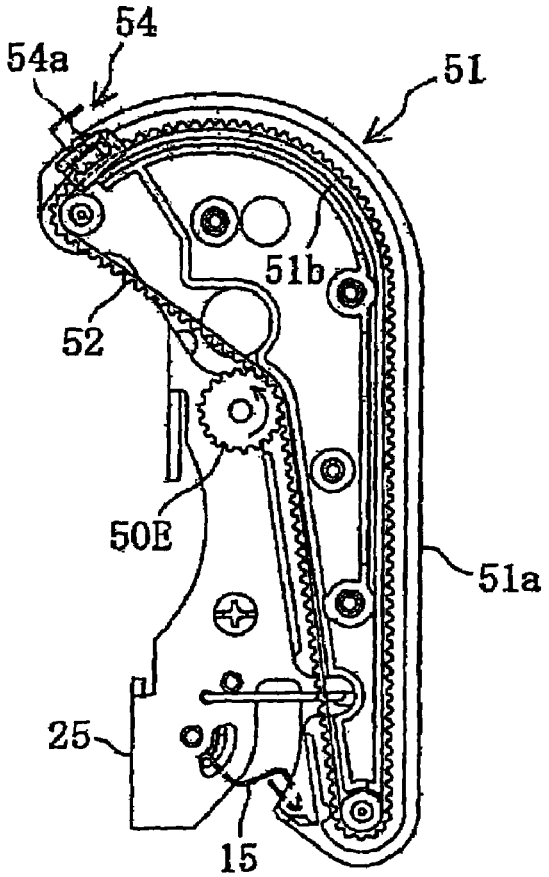
FIG. 20A is a left side view of the thread transferring mechanism when the first thread transferring member assumes a standby position.
Figure 20B:
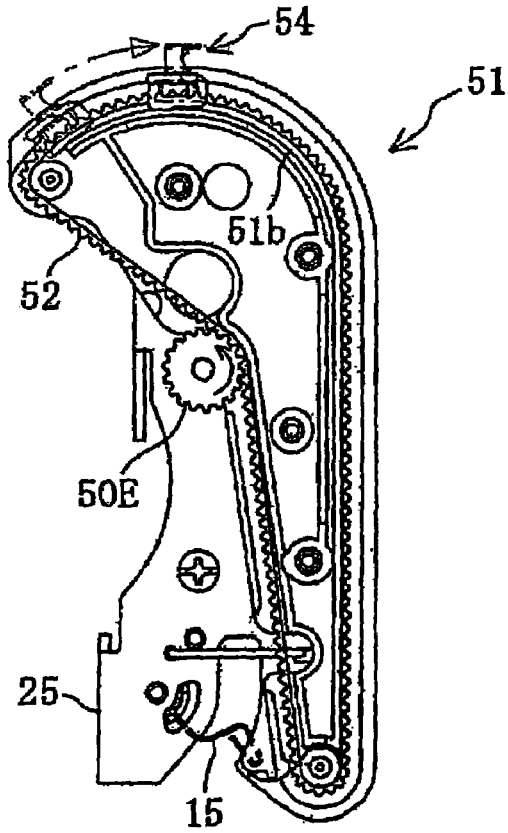
FIG. 20B is a left side view of the thread transferring mechanism when the thread is caught by the first thread transferring member.

The standby position of the first thread transferring member 54 is a movement start position of an upper end and a rear of the guide portion forming member 53, as shown in FIGS. 16A, 17A and 20A. The thread pass position of the first thread transferring member 54 is a movement end position of a lower end and the rear of the guide portion forming member 53. Accordingly, the first thread transferring member 54 is moved downward at a stroke along the inverted J-shaped path from the upper standby position to the lower thread passing position. Thus, when moved from the standby position to the thread passing position, the first thread transferring member 54 transfers the needle thread 10 downward while a part of the needle thread 10 previously set on the thread preparation path 30 is caught by the thread hook 54*a* during the downward movement. Accordingly, the needle thread 10 is set on the thread tension regulator 14 located upstream with respect to the first thread transferring member 54. When the first thread transferring member 54 has reached the lower thread passing position, the downward movement thereof is stopped.

Upon stop of the needle thread transfer, the needle thread 10 caught on the thread hook 54*a* assumes a position beneath the thread take-up spring 15. Subsequently, since the second thread transferring member 61 is continuously moved downward, the needle thread 10 is pulled toward the second thread transferring member 61 as the result of movement of the member 61, whereupon the needle thread 10 is disengaged from the thread hook 54*a* thereby to be introduced into the notch 25*a* from the lower end. As a result, the needle thread 10 is reliably set on the thread take-up spring 15 so that the thread take-up spring 15 is threaded.

A thread tension regulating mechanism 55 with the thread tension regulator 14 will be described. The thread tension regulating mechanism 55 includes a pair of thread tension discs 14*a* and 14*b* holding the needle thread 10 therebetween to apply tension to the needle thread 10. The thread tension regulating mechanism 55 further includes a compression coil spring 58 causing the movable thread tension disc to press against the fixed thread tension disc and a tension adjusting mechanism variably adjusting the spring force of the compression coil spring 58. The thread tension regulating mechanism 55 still further includes a thread tension stepping motor 59 operating the tension adjusting mechanism.

Describing the tension adjusting mechanism, a mounting plate 55*a* is secured to an upper end of the first guide frame 25. A pivot shaft (not shown) is fixed to the mounting plate 55*a* so as to extend perpendicularly to the mounting plate 55*a*. A circular tension adjusting gear 56 is rotatably mounted on the pivot shaft. The tension adjusting gear 56 has a rear face on which is formed an arc-shaped cam (not shown) which makes a part of helicoid. A generally L-shaped thread tension plate 57 has a right end engaging the arc-shaped cam. A spring receiving pin 57*a* directed leftward is secured to the thread tension plate 57. The pin 57*a* has a distal end (left end) partially fitted in the thread tension shaft 14*c* secured to the first guide frame 25. A compression coil spring 58 is interposed between the thread tension disc 14*b* and the thread tension plate 57. The thread tension stepping motor 59 is fixed to the mounting plate 55*a* and includes a driving gear 59*a* fixed to a drive shaft extending through mounting plate 55*a*. A tension adjusting gear 56 is in mesh engagement with the driving gear 59*a*.

Upon drive of the thread tension stepping motor 59, the driving gear 59*a* and accordingly the tension adjusting gear 56 are rotated, so that the thread tension plate 57 engaged with the arc-shaped cam is moved right and left. On one hand, as the thread tension plate 57 is moved rightward, the spring force of the compression coil spring 58 becomes smaller and the tension produced by the thread tension regulator 14 is reduced finally to zero. On the other hand, as the thread tension plate 57 is moved leftward, the spring force of the compression coil spring 58 becomes larger and the tension produced by the thread tension regulator 14 is increased.

The second thread transferring mechanism 60 includes a pair of right and left second guide frames 62 and 63 secured to the sewing machine frame in parallel to each other. The second thread transferring mechanism 60 further includes a movable frame 64 supported on the second guide frames 62 and 63 and a second thread transferring member 61 supported on the movable frame 64. The second thread transferring mechanism 60 still further includes a second driving mechanism 65 driving the movable frame 64 and the second thread transferring member 61. The movable frame 64 is movable between an initial position as shown in FIGS. 16A and 17A and a projecting position as shown in FIGS. 16E and 17E. The second thread transferring member 61 is movable between the standby position as shown in FIGS. 16A and 17A and the thread passing position as shown in FIGS. 16E and 17E with addition of movement of the movable frame 64.

The second guide frames 62 and 63 are provided on the left of the needle bar 12 and the thread take-up lever 13. The second guide frames 62 and 63 are vertically elongated plate-like frames and are spaced away from each other so as to be opposed to each other. The movable frame 64 is provided between the guide frames 62 and 63 so as to be movable. The movable frame 64 includes a pair of right and left slender movable pieces connected so as to be opposed to each other. The second thread transferring member 61 is movably supported via a support thereof (not shown) on the movable frame 64.

The second guide frames 62 and 63 are formed with longitudinal guide grooves 62*a* and 63*a* respectively. The movable frame 64 is guided by the guide grooves 62*a* and 63*a* so as to be movable. Furthermore, the paired guide pieces of the movable frame 64 are also formed with longitudinal guide grooves 64*a* respectively. The second thread transferring member 61 includes a support portion supported in the guide grooves 64*a*.

At the standby position, the second thread transferring member 61 assumes a downwardly directed position right in front of and below the thread take-up lever 13 which has been moved to the thread catching position, as shown in FIGS. 16A and 17A. At the thread passing position, the second thread transferring member 61 assumes a horizontal rear-facing position in front of the needle 19 as shown in FIGS. 16E and 17E.

The second thread transferring member 61 has a pair of right and left thread holding portions 61*a* and 61*b* capable of holding the needle thread 10 set in the thread preparation path 30. Each of the thread holding portions 61*a* and 61*b* is formed into a bifurcated shape so as to be capable of engaging the needle thread 10. However, the left thread holding portion 61*a* is constructed to pinch the needle thread 10 in cooperation with a separate thread pinching piece.

When moved downward from the standby position to the thread passing position, the second thread transferring member 61 holds, by the right thread holding portion 61*b*, the needle thread 10 set in the thread preparation path 30 and pinches the needle thread 10 by the left thread holding portion 61*a*, transferring the needle thread 10 downward. When the second thread transferring member 61 has reached the lower thread passing position, the needle thread 10 held between the thread holding portions 61*a* and 61*b* is located right in front of the thread eye 19*a* of the needle 19 and is on standby in a tensioned state.

The second driving mechanism 65 has a driving gear 66, double gears 67*a* and 67*b* and a rack forming member 68. The gears 66, 67*a* and 67*b*, the rack forming member 68 and the second stepping motor 69 (see FIG. 18) are disposed on the left of the second guide frame 62. The second stepping motor 69 is secured to the sewing machine frame and has an output shaft connected to the driving gear 66.

The double gears 67*a* and 67*b* are rotatably mounted on the sewing machine frame. The driving gear 66 is in mesh engagement with the large-diameter gear of the double gear 67*a*. The small-diameter gear of the double gear 67*a* is in mesh engagement with the large-diameter gear of the double gear 67*b*. The rack forming member 68 is guided by the second guide frames 62 and 63 so as to be vertically movable. A small-diameter pinion of the double gear 67*b* is in mesh engagement with the rack 68*a*.

Upon drive of the second stepping motor 69, a resultant driving force is transmitted via the driving gear 66, double gears 67*a* and 67*b* and rack 68*a* to the rack forming member 68, whereupon the rack forming member 68 is moved downward. When the rack forming member 68 is moved downward, the movable frame 64 connected via a plurality of pulleys and wire (not shown) to the rack forming member 68 is moved downward at a speed twice as large as the rack forming member 68. With this movement, the second thread transferring member 61 connected via a plurality of pulleys and wire (not shown) to the movable frame 64 is moved downward at a speed about twice as high as the movable frame 64 (that is, at a speed about four times higher than the rack forming member 68).

A thread guide threading mechanism 70 comprising link mechanisms is provided on lower rear ends of second guide frames 62 and 63. When the second thread transferring member 61 has been moved to the thread passing position, the needle thread 10 extending from the thread take-up lever 13 to the right thread holding portion 61*b* of the second thread transferring member 61 is caught by a threading hook member 71 to be set on the needle bar thread guide 18 provided on the lower end of the needle bar 11.

The automatic needle threading mechanism 17 will now be described. Referring to FIGS. 8, 9, 16A to 16F and 17A to 17F, the automatic needle threading mechanism 17 includes a needle threading shaft 80, a needle threading guide shaft 81, a needle threading slider 82, a hook mechanism 83 and a rotating mechanism (not shown). The needle threading shaft 80 is provided right on the left of the needle bar 11 so as to be vertically movable and vertically directed. The needle threading guide shaft 81 is provided right on the left of the needle threading shaft 80 so as to be vertically movable with the needle threading shaft 80. The needle threading slider 82 is fitted with upper ends of the needle threading shaft 80 and needle threading guide shaft 81 so as to be vertically movable. The hock mechanism 83 has a needle threading hook (not shown) provided on a lower end of the needle threading shaft 80. The rotating mechanism rotates the needle threading shaft 80 about 90 degrees so that the needle threading hook is passed through the thread eye 19*a* of the needle 19 at a lower limit position of the needle threading shaft 80. The slider 82 is vertically moved in synchronization with the rack forming member 68.

Accordingly, the needle threading mechanism 17 is moved downward in synchronization with the second thread transferring mechanism 60 of the automatic threading device 16. The needle threading shaft 80 reaches a lower limit position immediately before the second thread transferring member 61 is moved to the thread passing position. The needle threading hook of the hook mechanism 83 is rotated in one direction of reciprocation about 90 degrees such that the needle threading hook is passed through the thread eye 19*a* of the needle 19. At this time, the needle thread 10 held by second thread transferring member 61 is caught on the needle threading hook. Thereafter, the needle threading hook of the hook mechanism 83 is rotated about 90 degrees in the other direction of reciprocation thereby to be pulled out of the thread eye 19*a* of the needle 19. In this case, the needle thread 10 is passed through the thread eye 19*a* and thereafter, the needle threading shaft 80 is moved upward to be returned to the original position. Refer to FIG. 16 of JP-A-2004-41355 about the above-described operations of the needle threading hook and the needle.

The thread preparation path 30 will be described. The thread preparation path 30 is a path preparing the needle thread 10 drawn from the thread spool 9 to be set on a plurality of threaded portions (the thread tension regulator 14, the thread take-up spring 15, the thread take-up lever 13, the needle bar thread guide 18 and the like) by the automatic threading device 16, as described above. The operator manually introduces the needle thread from the thread introduction groove 31 formed in the sewing machine cover 35 previously, so that the thread preparation path 30 is threaded.

Referring to FIGS. 4, 8, 16A and 17A, the thread introducing groove cover 35*b* has a lower right end which is recessed leftward to be formed into a recess 36. Two threading members 90 and 91 are provided which face the outside in the recess 36. A plate-shaped pretensioner 93 is provided between the first guide frame 25 and the threading member 91 inside the sewing machine cover 35. The pretensioner 93 is capable of pressing the needle thread 10 against a receiving plate 92 by a suitable pressing force. A vertically protruding shaft-like threading member 94 is provided on the left of the pretensioner 93. A threading member 95 is provided beneath the right thread holding portion 61*b* of the second thread transferring member 61 assuming the standby position and on the right of a movement locus of the second thread transferring member 61.

The threading member 95 (see FIG. 17A) serves to lock the needle thread 10 at a predetermined position temporarily in order that the needle thread 10 may be set on both thread holding portions 61*a* and 61*b* after start of transfer of the second thread transferring member 61 although the aforesaid construction is not shown. Furthermore, another threading member 96 (see FIG. 4) is provided so as to face a longitudinal groove of the L-shaped introducing groove 34*d* between the thread guide cover 35*d* and the face plate 35*f*.

The needle thread 10 set on the thread preparation path 30 will be processed as follows. The needle thread 10 is drawn leftward from the thread spool 9 and set onto the threading member 90 from above. The needle thread 10 is then set onto a lower threading portion 91*a* of the threading member 91 from below, extending upward. The needle thread 10 is further set onto an upwardly protruding threading portion 91*b* of the threading member 91 from the front, extending through the right and rear of the threading portion 91*b* leftward.

The needle thread 10 extending leftward from the threading portion 91*b* passes between the receiving plate 92 and the pretensioner 93, set onto a shaft-like threading portion 94 from the rear. The needle thread 10 is then set onto the introduction guide portion 43 of the thread take-up lever 13 assuming the threading position from the rear. The needle thread 10 located between the threading portion 94 and the introduction guide portion 43 assumes such a position that the needle thread 10 is reliably set on the first thread transferring member 54 moved from the standby position to the thread passing position along the guide 53*a* of the guide portion forming member 53.

The needle thread 10 set on the introduction guide portion 43 of the thread take-up lever 13 extends forward and downward and is then set onto the threading portion 95, extending leftward. The needle thread 10 is then set onto a lower threading portion 96*a* of the threading member 96 and extends upward. The needle thread 10 is then set onto an upper threading portion 96*b* of the threading member 96 thereby to be held. The downstream end of the needle thread 10 is cut by a cutter 97 mounted on the threading member 96.

When the threading portions are threaded as described above, the needle thread 10 between the threading members 95 and 96 extends across a movement path of the paired thread holding portions 61*a* and 61*b* of the second thread transferring member 61. When the thread holding portions 61*a* and 61*b* of the second thread transferring member 61 are moved from the standby position to the thread passing position, the needle thread 10 is reliably caught and transferred.

Figure 18:
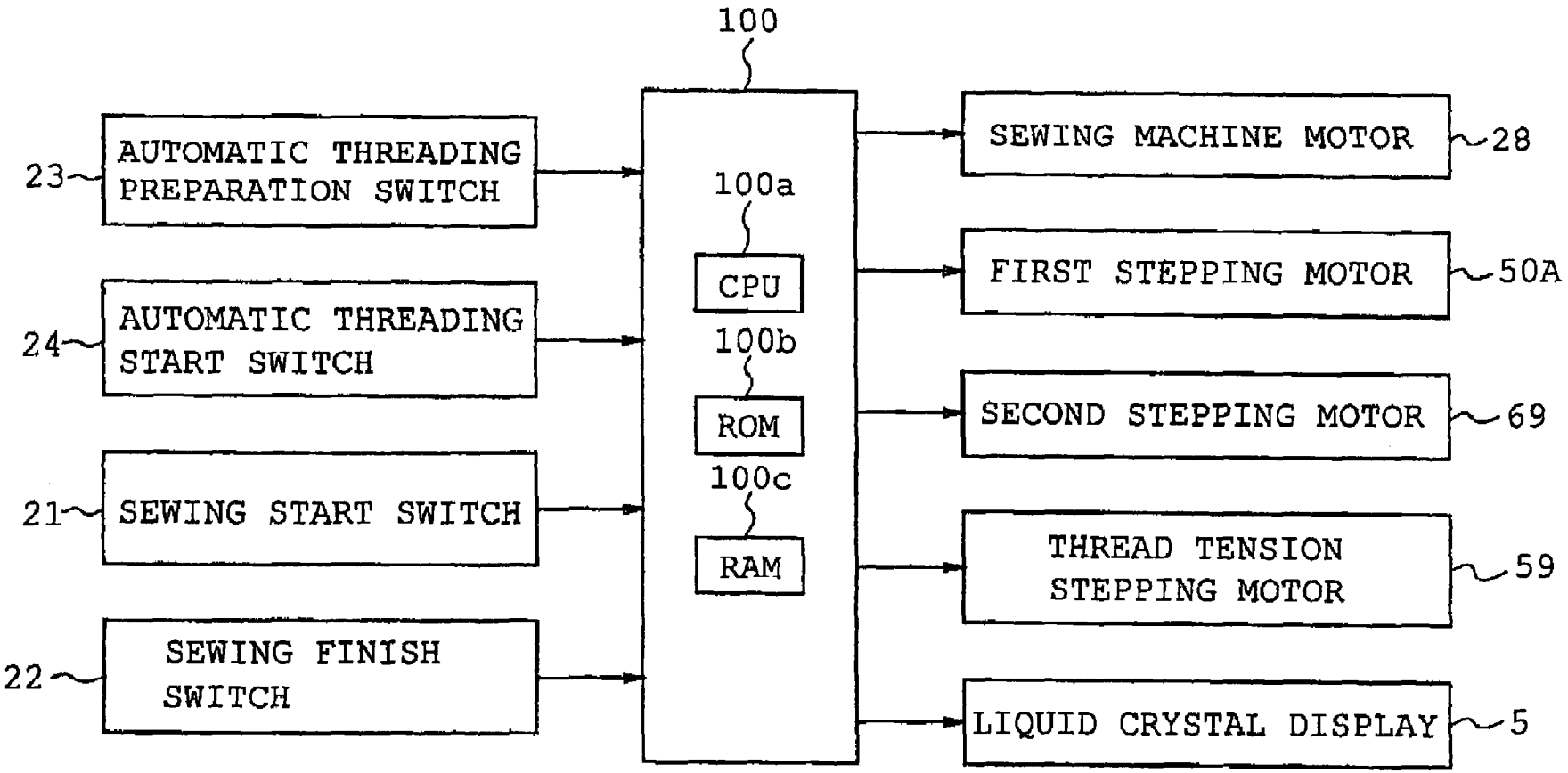
FIG. 18 is a block diagram of control system of the sewing machine.

A control system of the sewing machine M will be described in brief. Referring to FIG. 18, a microcomputer 100 composing a control device includes a CPU 100*a*, a ROM 100*b*, a RAM 100*c* and the like. The microcomputer 100 is supplied with input signals from an automatic threading preparation switch 23, a sewing start switch 21, a sewing finish switch 22 and the like, thereby controlling the sewing machine motor 28, the first stepping motor 50A, the second stepping motor 69, the thread tension stepping motor 59, the liquid crystal display 5 and the like.

In this case, the ROM 100*b* stores data of sewing data for various types of practical stitches and drive control program for controlling the motors 28, 50A, 59, 69 of the sewing machine M, a control program for controlling the liquid crystal display 5 and a control program for controlling transfer of the first thread transferring member 54 and the like. The RAM 100*c* is provided with various memories for storing data of results of computation processed by the CPU 100*a*, a pointer, counters and the like.

Figure 19:
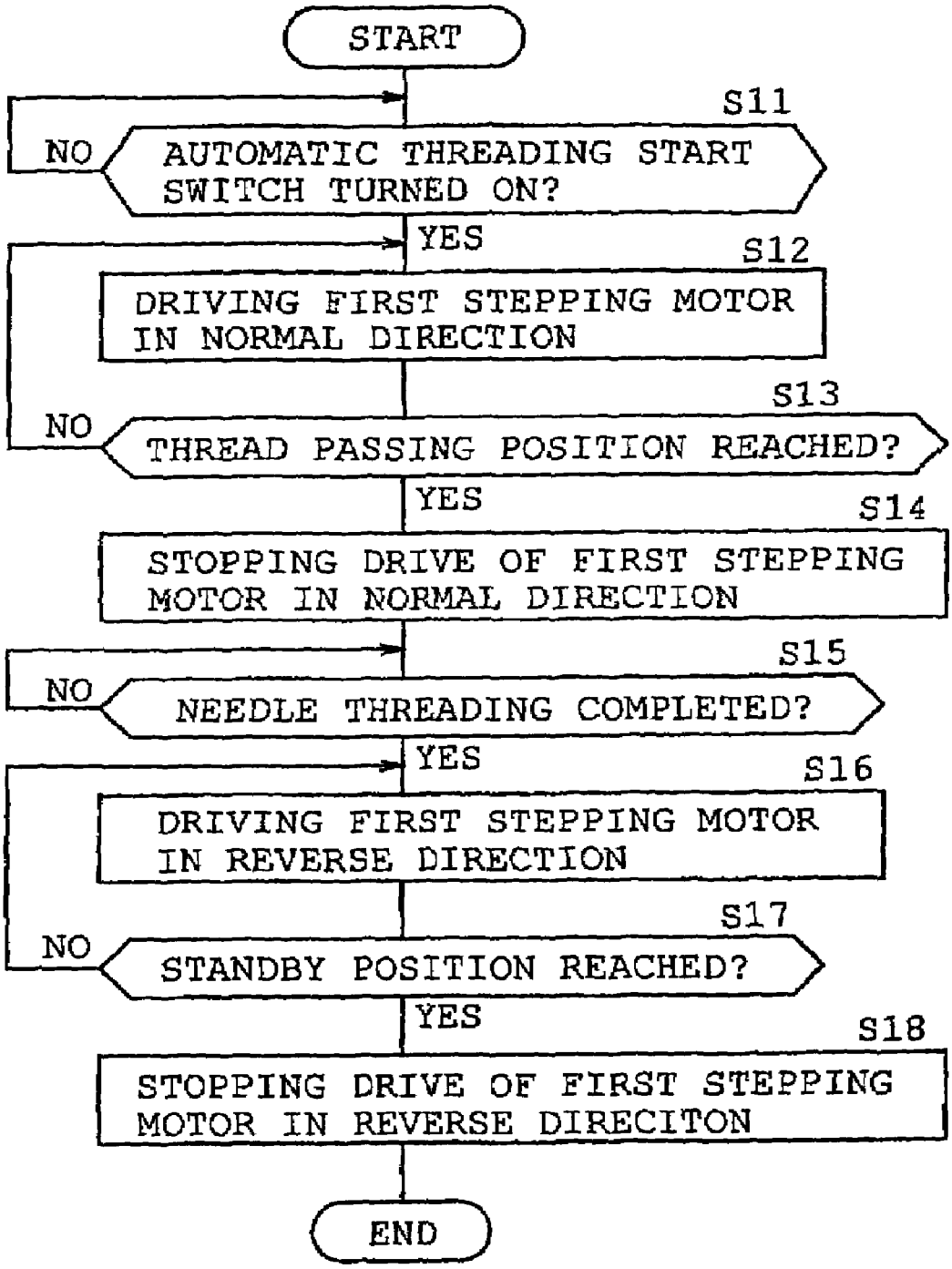
FIG. 19 is a flowchart showing control for transfer of the first thread transferring member.

A transfer control routine executed by a control device 100 will be described with reference to a flowchart of FIG. 19. Reference Si (where i=11, 12, 13 . . . ) designates each step. Upon turn-on of the sewing machine M, the aforesaid control starts. When the automatic threading start switch 24 is operated in the threading (S11: Yes), the stepping motor 50A is driven in the normal rotation, the first thread transferring member 54 is moved from the standby position to the lower thread passing position (S12). Thereafter, when the fist thread transferring member 54 has reached the thread passing position as the result of drive of the first stepping motor 50A by a predetermined number of steps (S13: Yes), the normal rotation of the first stepping motor 50A is stopped (S14).

When the needle threading has been completed by the automatic needle threading mechanism 17 with the second thread transferring member 61 assuming the thread passing position (S15: Yes), the stepping motor 50A is reverse rotated so that the first thread transferring member 54 is moved from the thread passing position toward the upper standby position (S16). Subsequently, the first stepping motor 50A is driven by a predetermined number of steps. When the first thread transferring member 54 has reached the standby position (S17: Yes), the reverse rotation of the first stepping motor 50A is stopped (S18).

The sewing machine M thus constructed will be operated as follows. The thread setting of the needle thread 10 is carried out by the above-described the automatic threading device 16 when the needle thread 10 happens to cut off during a sewing operation or the thread spool 9 is changed from one to another. In the automatic threading, the automatic threading preparation switch 23 is operated so that the thread take-up lever 13 not assuming the thread hook position is automatically moved to the thread hook position to be stopped.

Subsequently, the needle thread 10 drawn from the thread spool 9 is inserted sequentially through the introducing grooves 34*a* to 34*d* along the thread introducing groove 3 formed in the sewing machine cover 35. The needle thread 10 is finally turned around so as to straddle the threading member 96 facing the vertical groove of the introducing groove 34*d* from above and set and held on the upper thread holding portion 96*b* temporarily, and a downstream side of the needle thread 10 is cut off by the cutter 97.

The preparation for the threading is thus carried out. Since the needle thread 10 inserted into the thread introducing groove 31 is previously set in the predetermined thread preparation path 30, the needle thread 10 is in a state of readiness to automatically be set on a plurality of the threading portions including the thread take-up lever 13, thread tension regulator 14 and the thread take-up spring 15. More specifically, the first and second thread transferring members 54 and 61 are located at the respective standby positions as shown in FIGS. 16A, 17A and 20A. The needle thread 10 set in the thread preparation path 30 particularly extends across the movement locus of the first thread transferring member 54 and is set on the introduction guide portion 43 from behind. Thus, the needle thread 10 extends across the movement paths of paired thread holding portions 61*a* and 61*b* of the second thread transferring member 61.

When the automatic threading start switch 24 is operated in the aforesaid state, the automatic threading starts. The first and second stepping motors 50A and 69 are driven substantially simultaneously so that thread transfer by the first thread transferring member 54 and thread transfer of the second thread transferring member 61 simultaneously start. Subsequently, the needle thread 10 located between the threading member 94 and the introduction guide portion 43 of the thread take-up lever 13 is transferred downward by the first thread transferring member 54 while caught on the thread hook 54*a*.

Figure 16C:
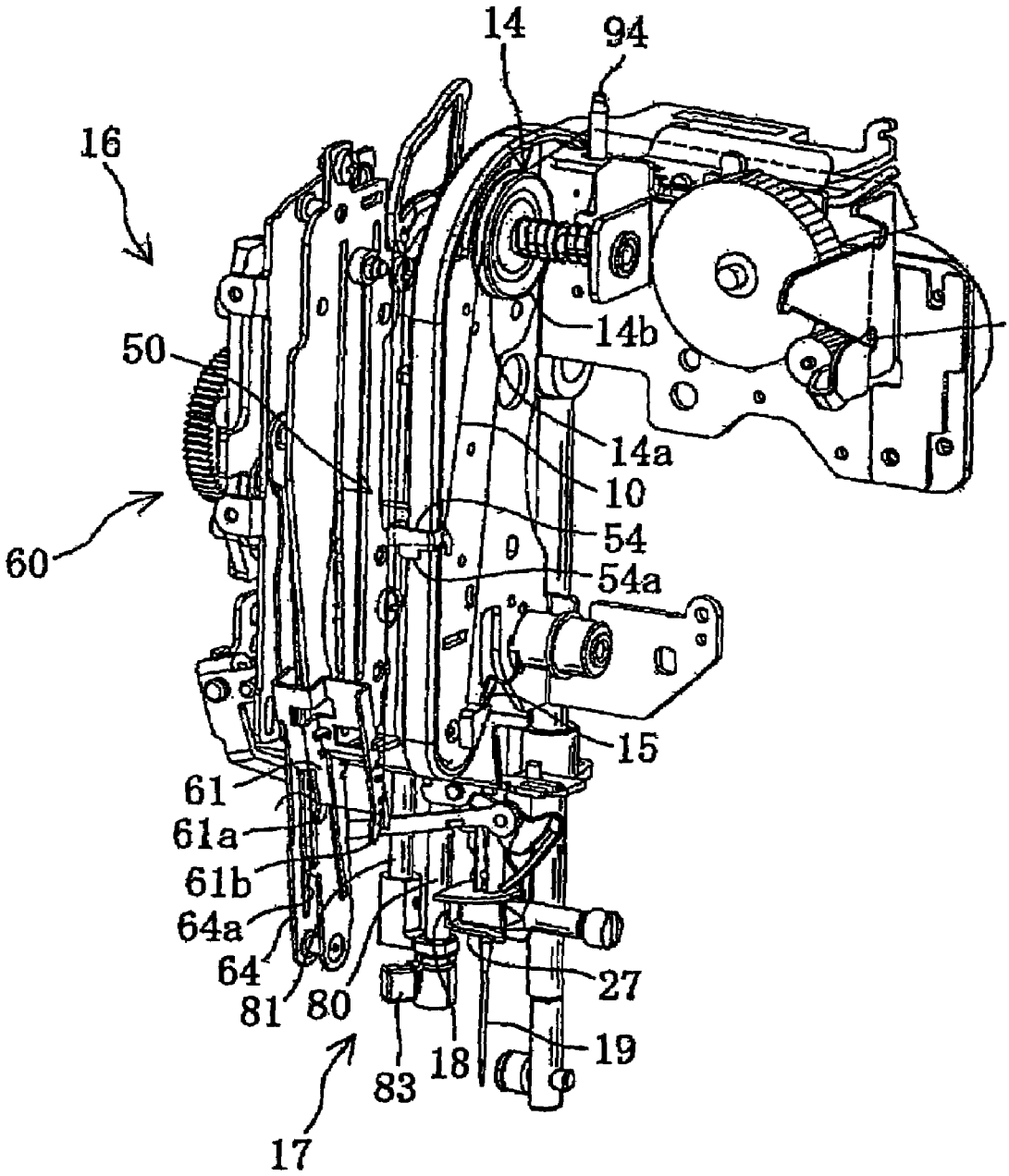
FIG. 16C is a perspective view of the automatic threader and the automatic needle threading mechanism in a condition where the thread take-up lever has been threaded.
Figure 16D:
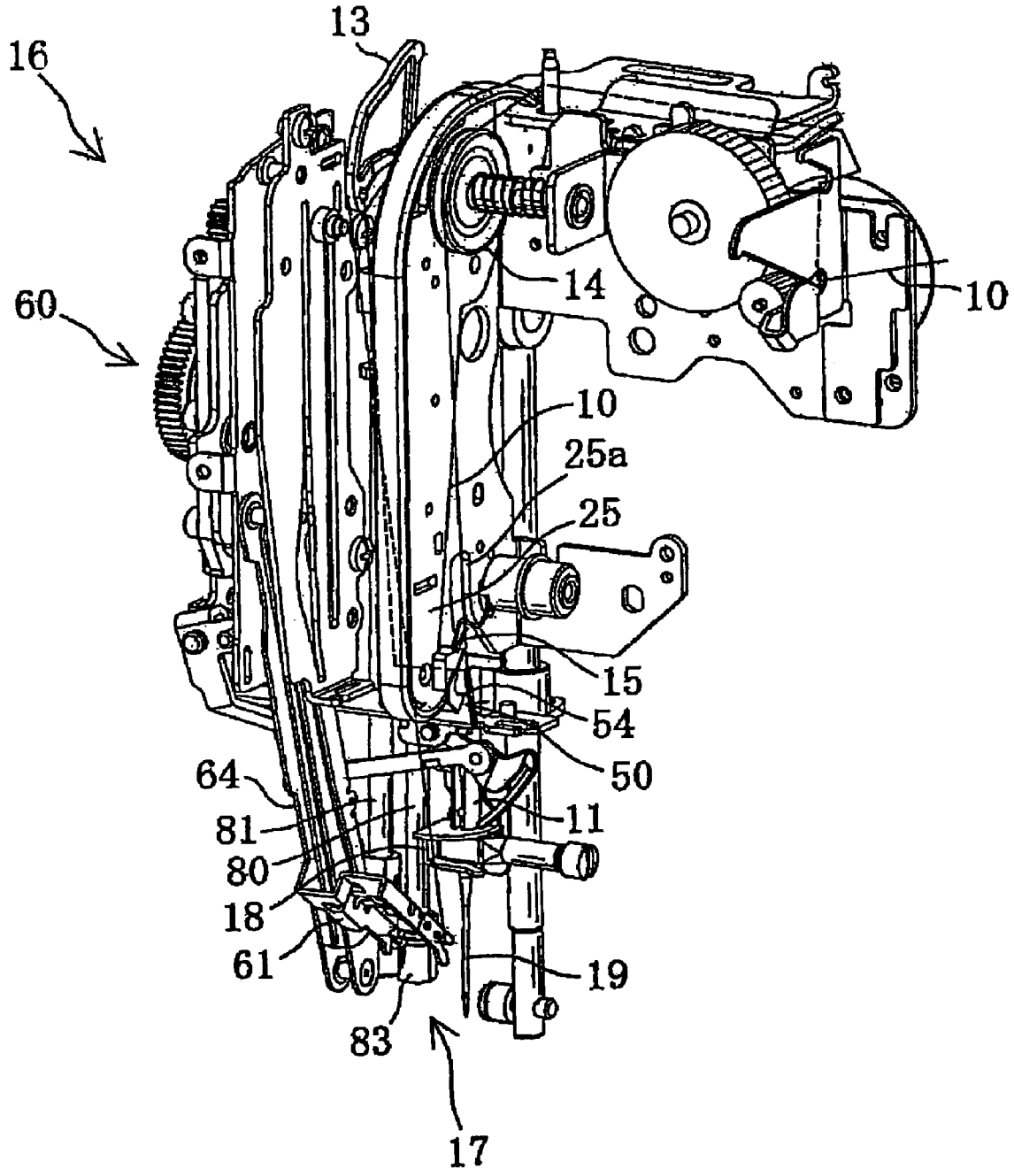
FIG. 16D is a perspective view of the automatic threader and the automatic needle threading mechanism in a condition where the thread take-up spring has been threaded.
Figure 16E:
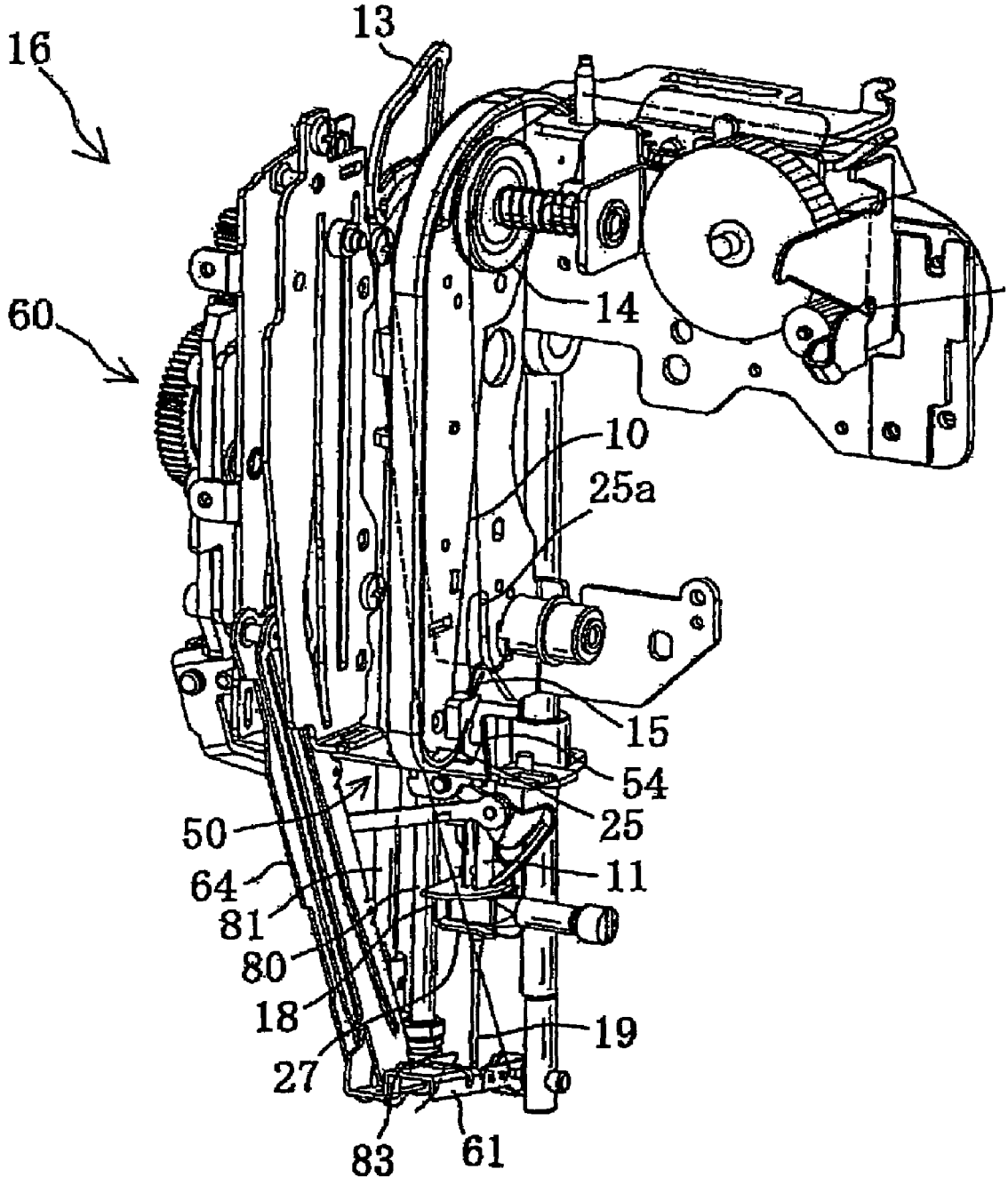
FIG. 16E is a perspective view of the automatic threader and the automatic needle threading mechanism in a condition where the needle thread assumes the thread passing position.
Figure 17C:
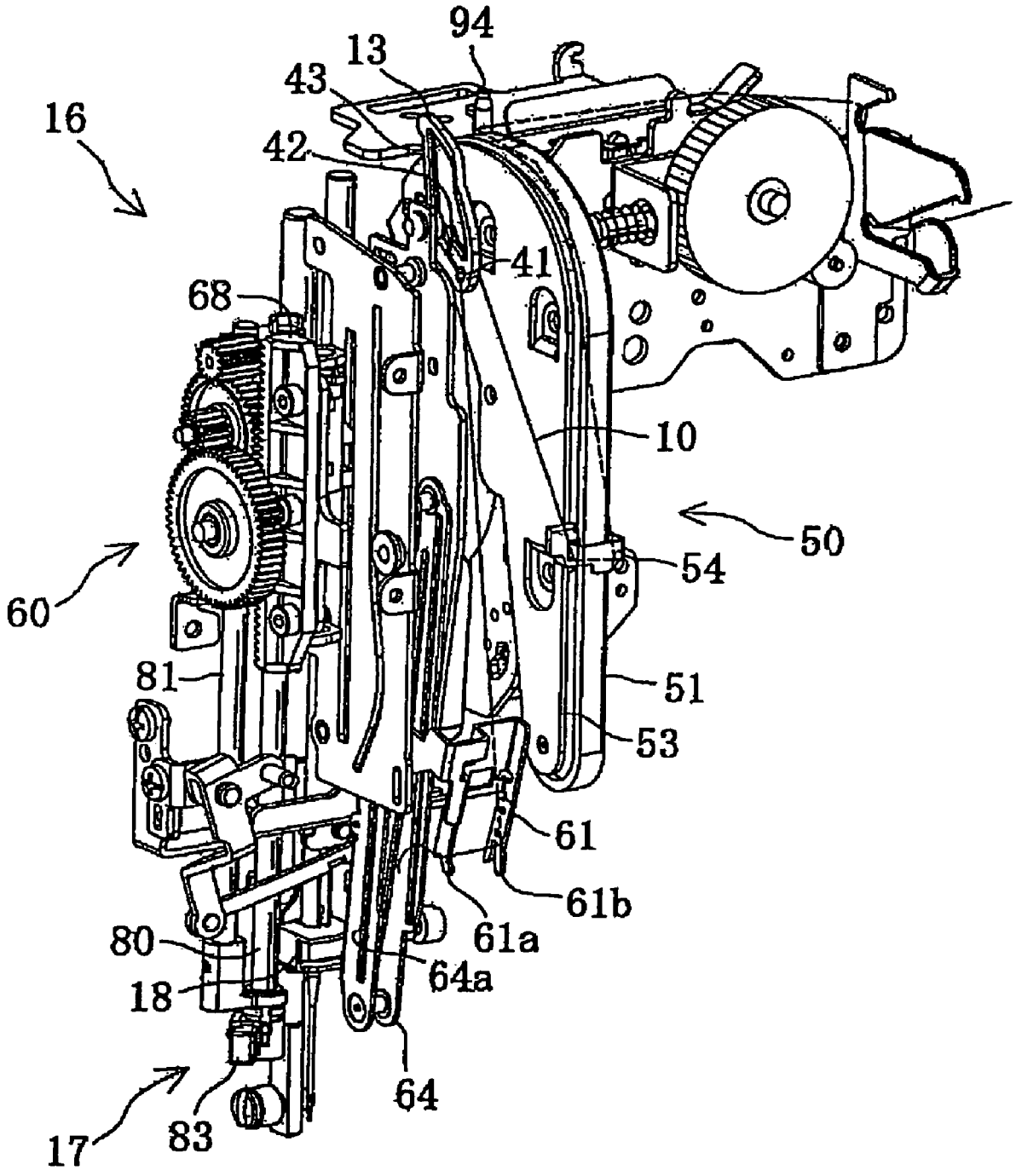
FIG. 17C is a perspective view of the automatic threader and the automatic needle threading mechanism in a condition where the thread take-up lever has been threaded.
Figure 17D:
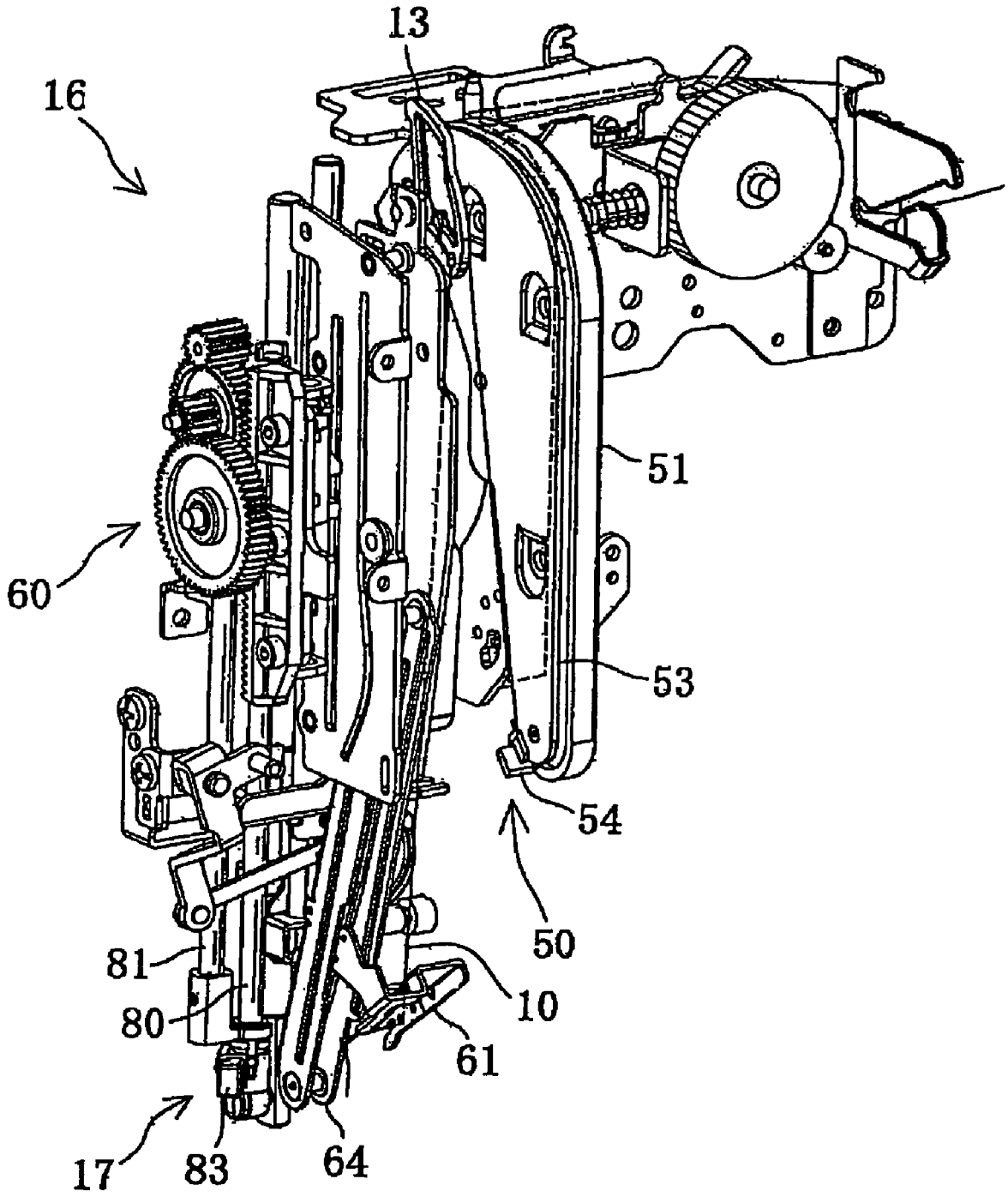
FIG. 17D is a perspective view of the automatic threader and the automatic needle threading mechanism in a condition where the thread take-up spring has been threaded.
Figure 17E:
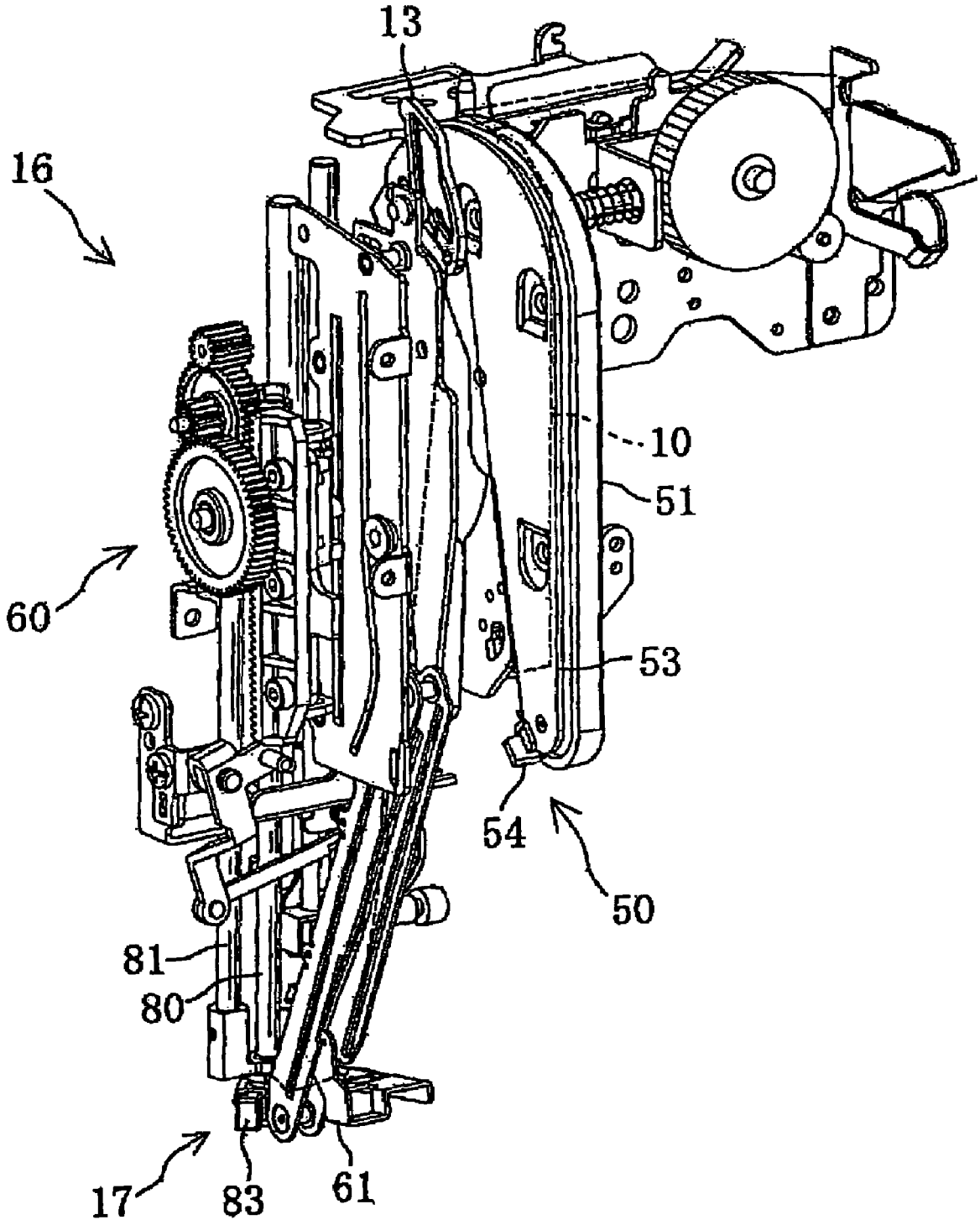
FIG. 17E is a perspective view of the automatic threader and the automatic needle threading mechanism in a condition where the needle thread assumes the thread passing position.
Figure 20C:
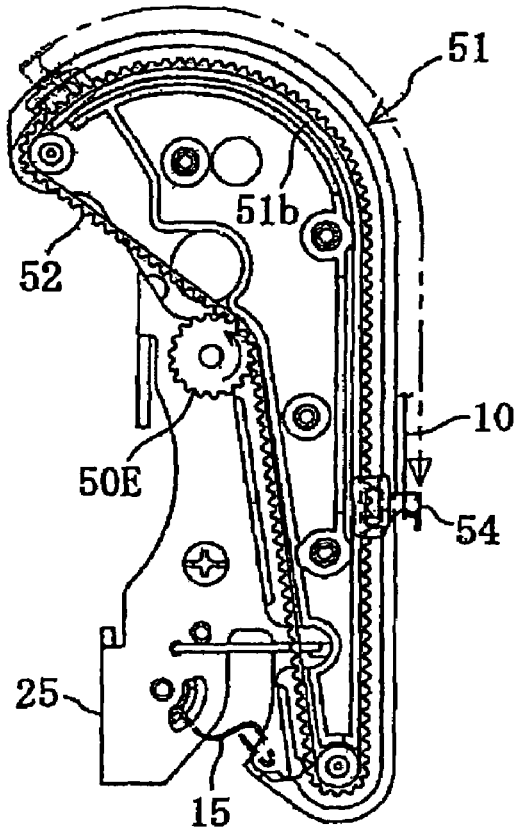
FIG. 20C is a left side view of the thread transferring mechanism when the thread is being transferred by the first thread transferring member.
Figure 20D:
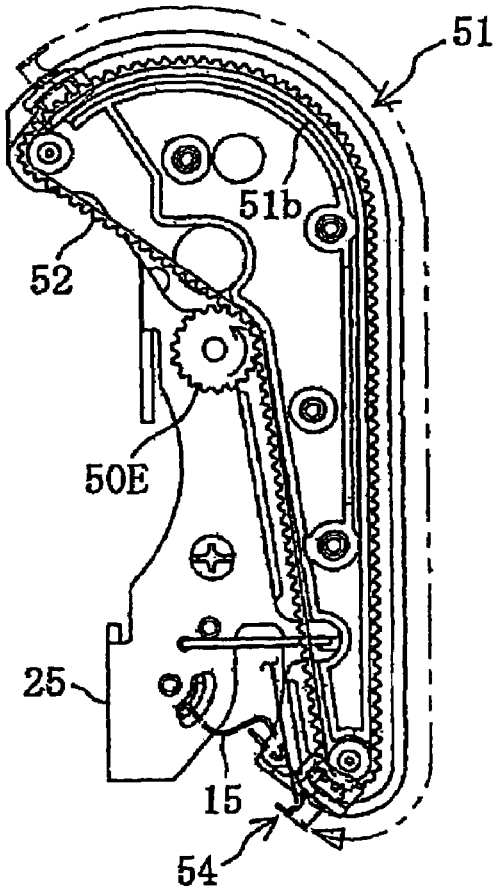
FIG. 20D is a left side view of the thread transferring mechanism when the first thread transferring member assumes a thread.

Successively, when the needle thread 10 is moved downward while caught on the first thread transferring member 54 and held by the second thread transferring member 61, the needle thread 10 from the thread spool 9 is drawn through the thread tension regulator 14 by the downward transfer of the first and second thread transferring members 54 and 61 while being pulled toward the first and second thread transferring members 54 and 61, as shown in FIGS. 16C, 17C and 20C. Accordingly, the introduction guide portion 43 guides, to the lever thread introducing portion 42, the needle thread 10 located between the thread transferring members 54 and 61 and set on the introduction guide portion 43 from behind. The needle thread 10 is then introduced to the lever threaded portion 41 by the lever thread introducing portion 42. Simultaneously, the needle thread 10 extending from the threading member 94 to the first thread transferring member 54 is set between the thread tension discs 14*a* and 14*b* of the open thread tension regulator 14. Furthermore, when the first thread transferring member 54 reaches the thread passing position and the thread transfer is stopped, the needle thread 10 caught by the thread hook 54*a* assumes a position beneath the thread take-up spring 15, as shown in FIGS. 16D, 17D and 20D. At this time, the second thread transferring member 61 assumes a position just before the thread passing position.

Accordingly, since the thread transfer by the second thread transferring member 61 is continuing, the needle thread 10 transferred beneath the thread take-up spring 15 is pulled by the second thread transferring member 61. As shown in FIGS. 16E and 17E, accordingly, the needle thread 10 transferred beneath the thread take-up spring 15 is introduced into the notch 25*a* and thereafter, set onto the thread take-up spring 15 from below.

Figure 16F:
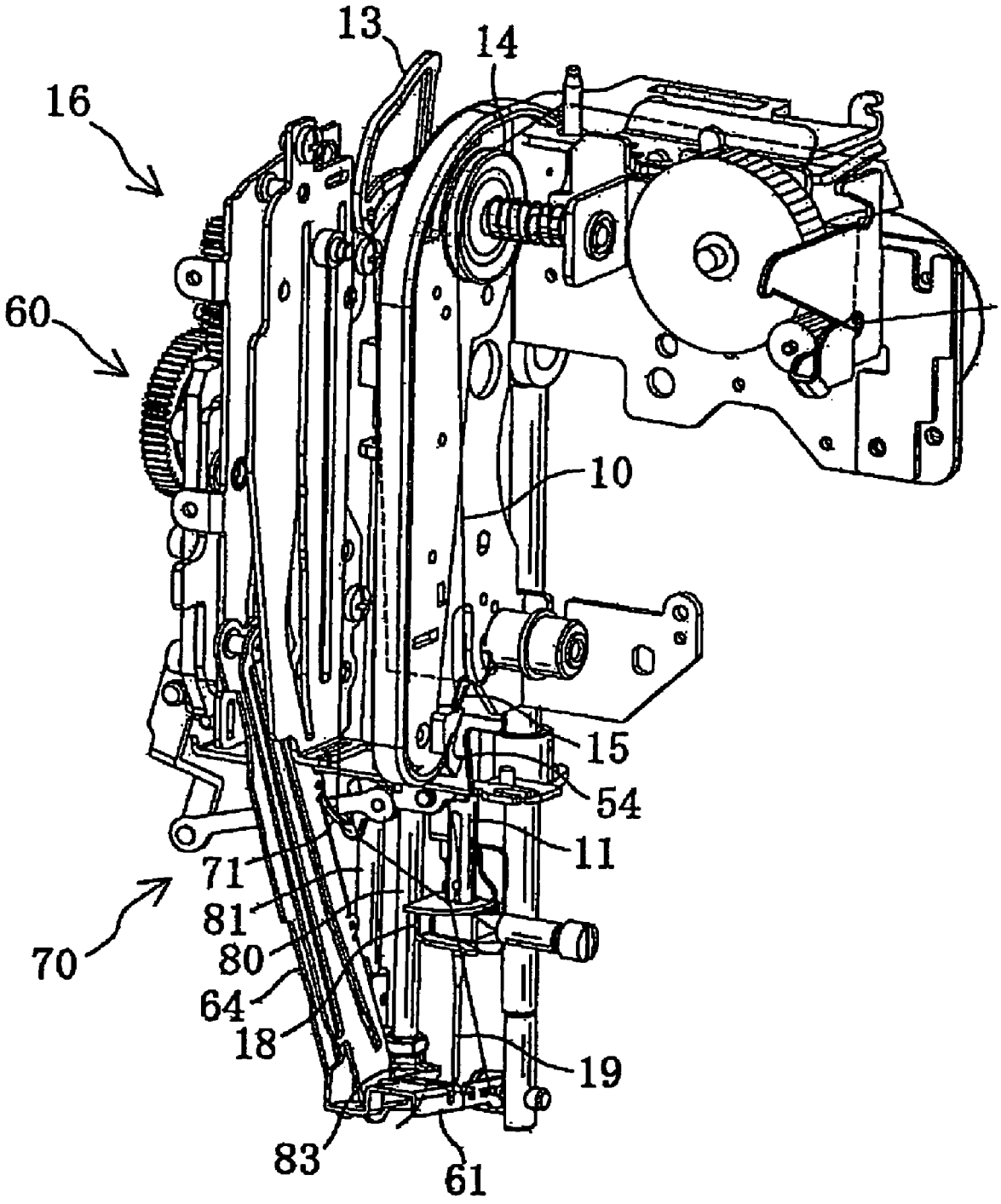
FIG. 16F is a perspective view of the automatic threader and the automatic needle threading mechanism in a condition where a needle bar has been threaded.
Figure 17F:
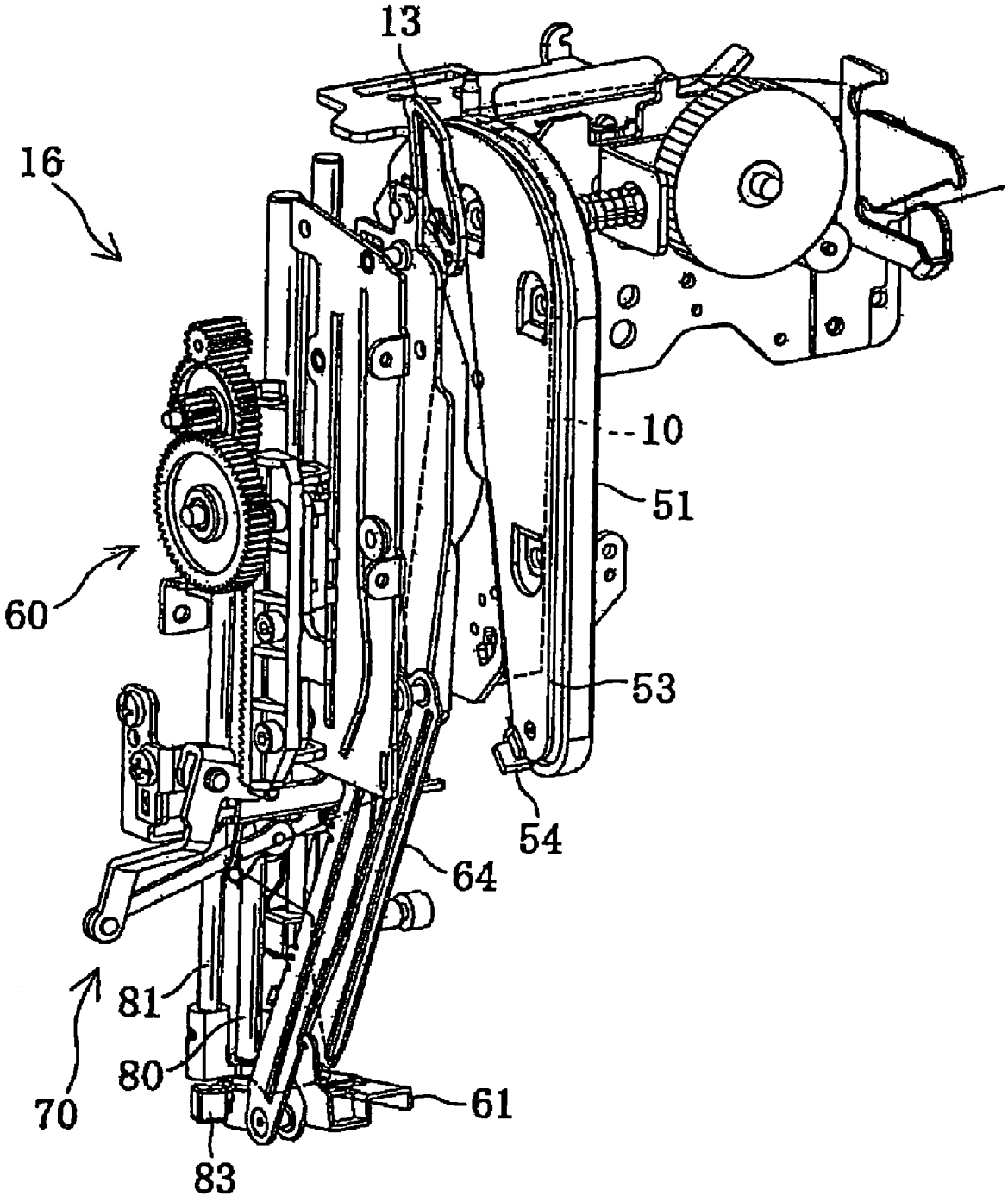
FIG. 17F is a perspective view of the automatic threader and the automatic needle threading mechanism in a condition where a needle bar has been threaded.

Immediately before the second thread transferring member 61 reaches the thread passing position, namely, at a final stage of the threading by the second thread transferring member 61, the thread guide threading mechanism 70 is operated in synchronization with the rack forming member 68 moved downward. As a result, the threading hook member 71 passes by in front of the needle bar 11 and switched to the threading position. Accordingly, as described above, since the needle thread 10 near the needle bar thread guide 18 is transferred so that the lower part of the needle thread 10 comes nearer to the needle bar thread guide 18 side, the needle thread 10 is reliably caught by the threading hook member 71 swinging on a vertical plane. While catching the needle thread 10, the threading hook member 71 passes by in front of the needle bar 11 to be switched to the threading position. During the switching to the threading position, the needle thread 10 caught by the threading hook member 71 is pulled to the needle bar thread guide 18 side to be set on the needle bar thread guide 18 reliably, as shown in FIGS. 16F and 17F.

On the other hand, the needle threading guide shaft 81 starts to move downward in synchronization with the automatic threading device 16. Substantially simultaneously with arrival of the second thread transferring member 61 at the thread passing position, the needle threading shaft 80 and the needle threading guide shaft 81 are moved downward together with the needle threading slider 82. When the needle threading hook reaches the same level as the thread eye 19*a* of the needle 19, the downward movement of the needle threading shaft 80 and the needle threading guide shaft 81 is stopped.

Subsequently, when the needle threading slider 82 is further moved downward, the needle threading hook of the hook mechanism 83 is rotated about a vertical axis by the rotating mechanism so that the threading hook is passed through the thread eye 19*a*, and the needle thread 10 held by the second thread transferring member 61 is caught on the needle threading hook. Thereafter, the needle threading hook of the hook mechanism 83 is rotated in the reverse direction so that the needle threading hook is pulled through the thread eye 19*a* such that the needle thread 10 is passed through the thread eye 19*a*.

Subsequently, the needle threading slider 82, the needle threading shaft 80 and the needle threading guide shaft 81 are moved upward to original positions respectively. Furthermore, the first and second thread transferring members 54 and 61 are also returned to original positions respectively. Accordingly, the threading regarding all the threading portions is completed at this time, whereupon the sewing machine is in a sewable state.

As described above, when the toothed belt 52 is driven via the sprocket 50E by the first stepping motor 50A, drive of the first stepping motor 50A is transmitted via the toothed belt 52 to the first thread transferring member 54. While catching on the thread hook 54*a* the needle thread 10 from the thread supply, the first thread transferring member 54 is guided along the predetermined thread transferring path from the upper standby position to the lower thread passing position by the guide portion 53*a* of the guide forming member 53 formed into the substantially inverted J-shape. As a result, the needle thread 10 can automatically be set on the thread take-up lever 13, the thread tension regulator 14 and the thread take-up spring 15 sequentially.

Furthermore, the toothed belt 52 is an endless looped belt with a number of teeth 52*a* and is disposed with the teeth 52*a* being directed outward. Consequently, the inside plane of the looped toothed belt 52 is slid on the continuous inner peripheral side wall 51*b*, whereupon the inside plane of the looped toothed belt 52 can smoothly be guided. Accordingly, a guide path for the toothed belt 52 can readily be formed, and moreover, the freedom in the design of the guide path can be improved since various shapes of paths such as an curved path can readily be formed by the inner peripheral side wall 51*b*. Additionally, since the looped toothed belt 52 with teeth 52*a* is employed as the drive transmitting member, a generally normal toothed belt can be used without additional processing, the cost of the drive transmitting member can be reduced.

Furthermore, the sewing machine includes the plate-shaped groove forming member 51 made from a synthetic resin and disposed in parallel to the vertical swinging face of the thread take-up lever 13 and the guide forming member 53 fixed to the groove forming member 51. The substantially inverted J-shaped guide groove 51*c* guiding the toothed belt 52 serving at least as a part of the guide path is formed near the outer edge of the groove forming member 51. The guide forming member 53 has the substantially inverted J-shaped outer edge conforming to the guide groove 51*c*, and the guide portion 53*a* is formed on the inverted J-shaped outer edge for guiding the first thread transferring member 54. Consequently, the toothed belt 52 can be guided along the substantially inverted J-shaped guide groove 51*c* formed near the outer edge of the groove forming member 51, and moreover, the first thread transferring member 54 can be guided along the guide portion 53*a* formed on the substantially inverted J-shaped guide groove 53*a* formed along the guide groove 51*c*.

Furthermore, the first thread transferring member 54 is constructed as a path forming member formed by integrating the support portion 54*b* with engagement teeth 54*c* in engagement with the teeth 52*a* of the toothed belt 52 within the guide groove 51*c* and the bifurcated guided portion 54*d* guided by the guide portion 53*a*. In order that the first thread transferring member 54 may be supported so as to be movable along the guide groove 51*c*, the guide forming member 53 is disposed so as to be spaced away by the predetermined distance t from the guide groove 51*c* of the groove forming member 51. Consequently, the first thread transferring member 54 is engaged via the support portion 54*b* with the teeth 52*a* of the toothed belt 52, thereby being capable of transferring the needle thread. Furthermore, the thread hook 54*a* of the first thread transferring member 54 can be exposed outward through the gap of the predetermined distance t defined between the guide forming member 63 and the groove forming member 51. Accordingly, the thread hook portion 54*a* can be moved along the guide groove 51*c* with the needle thread 10 hooked by the 54*a* while being guided via the guided portion 54*d* by the guide portion 53*a*.

Furthermore, the first thread transferring member 54 can be driven by the toothed belt 52 when the engagement tooth 54*c* is engaged with any one of the teeth 52*a* of the toothed belt 52. Consequently, the assembly of the first thread transferring member 54 onto the toothed belt 52 can be simplified to a large extent, and an assembly position of the first thread transferring member 54 can easily be changed so as to obtain a predetermined thread transfer timing.

Furthermore, the first thread transferring member 54 is driven by the first stepping motor 50A, and the first stepping motor 50A is controlled by the control device 100 so that the first thread transferring member 54 is moved downward along the guide groove 51*c* and the guide portion 53*a* for the threading operation and so that the first thread transferring member 54 is returned along the guide groove 51*c* and the guide portion 53*a* after the threading operation. Consequently, in the threading operation, when the first stepping motor 50A is controlled by the control device 100 so that the first thread transferring member 54 is moved downward to the lower thread passing position along the guide groove 51*c* and the guide portion 53*a*, the thread take-up lever 13, thread tension regulator 14 and thread take-up spring 15 can be threaded and so that the first thread transferring member 54 is moved to the upper standby position along the guide groove 51*c* and the guide portion 53*a*. Thus, the control for transfer of the thread transferring member 54 can be simplified.

Several modified forms of the foregoing embodiment will be described. A slender wire may be used instead of the toothed belt 52. In this case, a part of the wire may be wound on a drive shaft of the driving motor.

Furthermore, the groove forming member 51 may comprise a plate-shaped member with a predetermined thickness, and only the substantially inverted J-shaped guide groove may be formed near the outer periphery of the groove forming member 51.

Furthermore, various changes may be made in the first thread transferring mechanism without departing from the scope of the invention. Additionally, the invention may applied to threaders of various types of household and industrial sewing machines.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. A threader for a sewing machine comprising:

a thread tension regulator;

a thread take-up spring;

a thread take-up lever;

a thread transferer setting a needle thread drawn from a thread supply onto the thread tension regulator, the thread take-up spring and the thread take-up lever so that the thread tension regulator, the thread take-up spring and the thread take-up lever are threaded;

a path forming member forming a guide path guiding the thread transferer so that the thread transferer is moved;

a driving unit driving the thread transferer; and a drive transmitting member transmitting drive of the driving unit to the thread transferer.

2. The threader according to claim 1, wherein the drive transmitting member comprises an endless looped toothed belt including a number of teeth directed outward relative to the loop.

3. The threader according to claim 2, wherein the thread take-up lever is swingable vertically on a plane and the path forming member has a plate-shaped groove forming member made from a synthetic resin and disposed in parallel to the plane on which the thread take-up lever is vertically swung and a guide portion forming member fixed to the groove forming member, wherein the groove forming member has an outer edge near which a substantially inverted J-shaped guide groove is formed at least as a part of the guide path, for guiding the toothed belt, and wherein the guide portion forming member has a substantially inverted J-shaped outer edge formed along the guide groove, the outer edge being formed with a guiding portion guiding the thread transferer.

4. The threader according to claim 3, wherein the thread transferer includes a support portion having a plurality of engagement teeth in engagement with the teeth of the toothed belt in the guide groove and a guided portion guided by the guiding portion, and wherein the guide portion forming member is disposed at a position spaced away from the guide groove side of the groove forming member by a predetermined distance so that the thread transferer is supported by the guide portion forming member so as to be movable along the guide groove.

5. The threader according to claim 3, in which the driving unit comprises a stepping motor and which further comprises a control device controlling the stepping motor so that, in threading the sewing machine, the thread transferer is moved downward along the guide groove and the guide portion for thread setting and so that, after thread setting, the thread transferer is moved upward along the guide groove and the guide portion.

6. The threader according to claim 4, in which the driving unit comprises a stepping motor and which further comprises a control device controlling the stepping motor so that, in threading the sewing machine, the thread transferer is moved downward along the guide groove and the guide portion for thread setting and so that, after thread setting, the thread transferer is moved upward along the guide groove and the guide portion.

* * * * *